US006540326B2

(12) United States Patent
Matsubara et al.

(10) Patent No.: US 6,540,326 B2
(45) **Date of Patent: *Apr. 1, 2003**

(54) INK JET RECORDING APPARATUS AND METHOD CAPABLE OF INCREASING DENSITY

(75) Inventors: Miyuki Matsubara, Tokyo (JP); Naoji Otsuka, Kawasaki (JP); Hiromitsu Hirabayashi, Yokohama (JP); Shigeyasu Nagoshi, Kawasaki (JP); Atsushi Arai, Kawasaki (JP); Kentaro Yano, Yokohama (JP); Yuji Akiyama, Yokohama (JP); Hitoshi Sugimoto, Yokohama (JP); Kiichiro Takahashi, Yokohama (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/831,759

(22) Filed: Apr. 1, 1997

(65) Prior Publication Data

US 2002/0122086 A1 Sep. 5, 2002

Related U.S. Application Data

(63) Continuation of application No. 08/326,359, filed on Oct. 20, 1994, now abandoned, which is a continuation of application No. 07/888,800, filed on May 27, 1992, now abandoned.

(30) Foreign Application Priority Data

May 31, 1991 (JP) ..... 3-129502
May 27, 1991 (JP) ..... 3-121100
May 11, 1992 (JP) ..... 4-117604

(51) Int. Cl.[7] ..... B41J 2/15
(52) U.S. Cl. ..... 347/41; 347/43; 347/15

(58) Field of Search ..... 347/40, 41, 43, 347/9, 12, 15, 16; 358/1.8, 1.9, 1.11, 1.12

(56) References Cited

U.S. PATENT DOCUMENTS

| | | | | |
|---|---|---|---|---|
| 4,313,124 A | 1/1982 | Hara | ..... | 346/140 R |
| 4,345,262 A | 8/1982 | Shirato et al. | ..... | 346/140 R |
| 4,459,600 A | 7/1984 | Sato et al. | ..... | 346/140 R |

(List continued on next page.)

FOREIGN PATENT DOCUMENTS

| | | |
|---|---|---|
| DE | 2425679 | 12/1974 |
| EP | 0315206 | 5/1989 |
| EP | 0376596 | 7/1990 |

(List continued on next page.)

OTHER PUBLICATIONS

B. Kockler, "Ink Jet Printer Stitching Improvement", Xerox Disclosure Journal, vol. 4, No. 2, Mar./Apr. 1979 pp 249–250.*

IBM Technical Disclosure Bulletin, Althauser, et al., "Dual Resolution Ink Jet Drum Printer", vol. 23, No. 7A, pp. 2700–2702, Dec. 1980.

*Primary Examiner*—Lamson Nguyen
(74) *Attorney, Agent, or Firm*—Fitzpatrick, Cella, Harper & Scinto

(57) ABSTRACT

A paper feed operation is performed by a width less than one pixel (½) in addition to an integer multiple number of pixels (n/2) with respect to a basic number of pixels inherent to an ink jet recording apparatus having a multi nozzle head having n nozzles. When a plurality of pixel recording operations are performed for a single pixel region, ink dots land within a distance less than one pixel unit (½). Thus, a variation in ink surface density on a recording sheet in an overlapping print operation is reduced, thereby efficiently increasing the image density, and preventing blurring by promoting absorption and evaporation of an ink to and from a paper sheet.

3 Claims, 20 Drawing Sheets

U.S. PATENT DOCUMENTS

| | | | | | |
|---|---|---|---|---|---|
| 4,463,359 | A | | 7/1984 | Ayata et al. | 346/1.1 |
| 4,558,333 | A | | 12/1985 | Sugitani et al. | 346/140 R |
| 4,617,580 | A | | 10/1986 | Miyakawa | 346/136 |
| 4,642,653 | A | * | 2/1987 | Ito et al. | 346/1.1 |
| 4,672,432 | A | * | 6/1987 | Sakurada et al. | 347/43 X |
| 4,703,323 | A | * | 10/1987 | Troupes et al. | 358/1.11 X |
| 4,723,129 | A | | 2/1988 | Endo et al. | 346/1.1 |
| 4,740,796 | A | | 4/1988 | Endo et al. | 346/1.1 |
| 4,750,009 | A | * | 6/1988 | Yoshimura | 347/43 |
| 4,809,021 | A | * | 2/1989 | Check et al. | 346/1.1 |
| 4,920,355 | A | * | 4/1990 | Katerberg | 347/41 |
| 4,963,882 | A | * | 10/1990 | Hickman | 347/41 |
| 4,965,593 | A | | 10/1990 | Hickman | 346/140 R |
| 5,012,257 | A | | 4/1991 | Lowe et al. | 346/1.1 |
| 5,079,563 | A | * | 1/1992 | Stankweather et al. | 346/1.1 |
| 5,121,142 | A | * | 6/1992 | Iwazawa et al. | 346/140 R |
| 5,182,575 | A | * | 1/1993 | Kato et al. | 346/108 |
| 5,202,659 | A | * | 4/1993 | Debonte et al. | 346/1.1 |
| 5,220,342 | A | * | 6/1993 | Moriyama | 347/43 |

FOREIGN PATENT DOCUMENTS

| | | | | |
|---|---|---|---|---|
| JP | 59123670 | | 7/1984 | |
| JP | 59138461 | | 8/1984 | |
| JP | 230952 | * | 10/1986 | 347/43 |
| JP | 216852 | * | 8/1989 | 347/43 |
| JP | 264852 | * | 10/1989 | 347/43 |
| JP | 0029347 | * | 1/1990 | |
| JP | 0140253 | * | 1/1991 | |

* cited by examiner

FIG.18A

| TABLE NO / CONDITION | [1] | [2] | [3] | [4] | [5] | [6] | [7] | [8] | [9] | [10] |
|---|---|---|---|---|---|---|---|---|---|---|
| HEAD TEMP TH[°C] | <26 | ≥26 TO <28 | ≥28 TO <30 | ≥30 TO <32 | ≥32 TO <34 | ≥34 TO <35 | ≥35 TO <38 | ≥38 TO <40 | ≥40 TO <42 | ≥42 |
| PRE-HEAT PULSE WIDTH P1 [Hex] | 0A | 09 | 08 | 07 | 06 | 05 | 04 | 03 | 02 | 01 |

FIG.18B

| TABLE NO / CONDITION | [1] | [2] | [3] | [4] | [5] | [6] | [7] | [8] | [9] | [10] |
|---|---|---|---|---|---|---|---|---|---|---|
| HEAD TEMP TH[°C] | <26 | ≥26 TO <28 | ≥28 TO <30 | ≥30 TO <32 | ≥32 TO <34 | ≥34 TO <36 | ≥36 TO <38 | ≥38 TO <40 | ≥40 TO <42 | ≥42 |
| PRE-HEAT PULSE WIDTH P1 [Hex] | 0C | 0B | 0A | 09 | 08 | 07 | 06 | 05 | 04 | 03 |

INK JET RECORDING APPARATUS AND METHOD CAPABLE OF INCREASING DENSITY

This application is a continuation of application Ser. No. 08/326,359 filed Oct. 20, 1994, which is a continuation of application Ser. No. 07/888,800 filed May 27, 1992, both now abandoned.

BACKGROUND OF THE INVENTION

1. Field of the Invention

The present invention relates to an ink jet recording apparatus and an ink jet recording method.

2. Related Background Art

As information processing apparatuses such as copying apparatuses, word processors, computers, and the like, and communication apparatuses have become popular, an apparatus for performing digital image recording using an ink jet recording head has become increasingly popular as one of image forming (recording) apparatuses of the above-mentioned apparatuses. Furthermore, with the advent of color, low-cost information processing apparatuses and communication apparatuses, a demand has arisen for a color recording apparatus, which can perform a print operation using normal paper sheets. Such a recording apparatus normally comprises, as a recording head (to be referred to as a multi head hereinafter) obtained by integrating and aligning a plurality of recording elements to improve the recording speed, a plurality of multi heads in each of which a plurality of ink ejection orifices and nozzles are integrated in correspondence with colors.

FIG. 1 shows an arrangement of a printer unit when a print operation is performed on a paper sheet using the multi heads. In FIG. 1, each of ink cartridges 701 is constituted by an ink tank filled with one of four color inks (black, cyan, magenta, and yellow), and a multi head 702. FIG. 2 shows a state of multi nozzles aligned on the multi head from the z-direction. In FIG. 2, multi nozzles 801 are aligned on the multi head 702.

Referring back to FIG. 1, a paper feed roller 703 is rotated in a direction of an arrow in FIG. 1 together with an auxiliary roller 704 while pressing a print sheet 707, thereby feeding the print sheet 707 in the y-direction. Paper supply rollers 705 supply the print paper, and also serve to press the print paper 707 like the rollers 703 and 704. A carriage 706 supports the four ink cartridges, and moves these cartridges according to a print operation. The carriage 706 stands by at a home position (h) indicated by a dotted line in FIG. 1 when no print operation is performed or when the multi heads are subjected to recovery operations.

Before a print operation is started, the carriage 706 is located at the illustrated position (home position), and when a print start command is input, the carriage 706 performs a print operation by a width D on the sheet surface using the n multi nozzles 801 on the multi heads 702 while moving in the x-direction. Upon completion of the data print operation to the end portion of the sheet surface, the carriage is returned to the home position, and then performs a print operation in the x-direction. During an interval after the first print operation is ended until the second print operation is started, the paper feed roller 703 is rotated in the direction of the arrow, thereby feeding the sheet in the y-direction by the width D. In this manner, the print operation and the paper feed operation are repetitively performed per scan of the carriage by the width D of the multi head, thus completing the data print operations on the sheet surface.

When the above-mentioned normal print operation is performed on a coating or coating paper sheet, which is prepared in consideration of ink absorption, no problem is posed. However, a normal paper sheet is prepared without taking a special countermeasure against absorption of a liquid, i.e., an ink, and suffers from a problem of a low black density as compared to the coating paper sheet, which is prepared in consideration of ink absorption. This problem is caused since the normal paper sheet has a considerably low blurring rate of an ink and a low absorption speed to a sheet as compared to the coating paper sheet.

In association with this problem, the most general dot landing state on a coating paper sheet in the above-mentioned ink jet recording apparatus will be described below with reference to FIGS. 3A and 3B. In this case, one pixel is constituted by one dot with respect to a pixel density inherent to a printer. The dot central points are aligned at an interval of one pixel unit, and an ejection amount is designed, so that when dots land, they partially overlap each other, as shown in FIG. 3A, to satisfy an area factor of 100%. Such an ejection amount design is determined by an ink used in recording, and the blurring rate of the ink on a paper sheet. For example, when a dot diameter of 100 $\mu$m for sufficiently satisfying an area factor of 100% at a pixel density of 360 dpi is realized on a paper sheet having a blurring rate of 2.7 times, at least an ejection amount given by the following equation is required:

$$4\pi(100/2.7/2)^3/3 \cong 26.6 \text{ pl/dot}$$

In this manner, satisfactory images are obtained using suitable ejection amount designs according to the relationship between the ink and the blurring rate of the ink on the paper sheet.

FIGS. 3A and 3B show a printed dot landing state when a print operation is performed using the above-mentioned method at a duty of 100% with respect to a predetermined pixel density. FIG. 3A shows a state wherein a print operation is performed on a coating paper sheet (blurring rate=2.7) with an ejection amount satisfying an area factor of 100%, as described above, and FIG. 3B shows a state wherein a print operation is performed on a normal paper sheet (blurring rate=2.0) with the same ejection amount as in FIG. 3A. FIGS. 3A and 3B illustrate states viewed from the horizontal and vertical directions. In the print state on the coating paper sheet shown in FIG. 3A, individual landing ink dots widely spread on the sheet surface, and adjacent dots in the diagonal directions also overlap each other. However, in the print state on the normal paper sheet shown in FIG. 3B, individual dots do not spread so largely on the sheet surface, and the amount of the ink penetrated in the vertical direction is increased. Therefore, a gap is formed between two adjacent dots in the diagonal direction on the sheet surface. The presence of such a gap largely contributes to a low density of the normal paper sheet.

As a simple method of increasing the density, a method of increasing the ejection amount to a state wherein an area factor of 100% is satisfied on a normal paper sheet is known. However, when a large amount of ink lands on the sheet surface at a time, a time required for causing an ink to penetrate into the sheet surface is further prolonged, and boundary blurring among different colors as another serious problem of the normal paper sheet is further worsened. The boundary blurring is a mixed flow phenomenon of the inks on the paper sheet caused since the normal paper sheet has a low ink absorption speed as compared to the coating sheet, as described above. When the ink ejection amount is increased, the ink penetration speed is further lowered, and different color inks tend to become easily blurred.

In order to solve the above-mentioned problem, a method of landing ink dots twice at identical landing points is proposed. In this method, in FIG. 1, the carriage 706 scans twice in the x-direction without rotating the paper feed roller. At this time, the second print operation is performed at the same position as the first print operation. When such print operations are performed, each ink dot area can be slightly increased, and the gap between adjacent dots in FIG. 3B can be decreased, thus obtaining a landing state shown in FIG. 3C. Therefore, the density can be increased as compared to the one-dot print operation. In addition, since the print operations of a single area is completed in a longer period of time than in a case wherein a large ejection amount of ink is printed at a time, blurring can be easily prevented to some extent.

However, in this case, the gaps cannot be completely eliminated unlike in the printed state on the coating paper sheet. When relatively small dots are printed adjacent to each other, a blank stripe still remains. In addition, the normal paper sheet suffers from the problem of blurring at a boundary portion between different colors in addition to the low black density, and this method further makes this problem worse.

In order to solve the above-mentioned problems, a method of landing dots at positions shifted by half a pixel in the moving direction of the carriage in the second print operation is proposed. In this embodiment, the carriage moving timing and the paper feed timing for black emphasis described above are left unchanged, and dots printed in the second print operation land not at the same positions as those in the first print operation but at positions shifted by half a pixel in the moving direction (main scanning direction) of the carriage. FIGS. 4A and 4B show this landing state in comparison with a printed state on the normal paper sheet. FIG. 4A shows an ink landing state on a normal paper sheet, and FIG. 4B shows dot landing point positions shifted by half a pixel in the main scanning direction in addition to the state shown in FIG. 4A.

According to this print method, even when the dot area is smaller than that on the coating paper sheet, since two dots overlap each other at shifted positions, the ink coverage can be increased as compared to a normal print method (FIG. 3A) or a black emphasis print method (FIG. 3C) for landing two dots at the same position described above, and hence, the density can be increased as compared to these methods. When two dots are printed to overlap each other at shifted landing point positions in this manner, the ink penetration speed to the paper sheet and the ink evaporation speed can be higher than those obtained when two dots are printed at the same position, and blurring between different colors can be suppressed. In this manner, the black density on a normal paper sheet can be efficiently increased while suppressing blurring as much as possible.

However, with the above-mentioned overlapping print method, the overlapping state of ink dots in the paper feed direction is insufficient. When the ejection direction is shifted in the paper feed direction, a blank stripe is formed across the carriage scanning direction, i.e., the main scanning direction.

In multi-nozzle heads, variations in ink ejection volume and ejection direction among nozzles and heads of ten occur in the manufacture of the heads and due to aging. In this case, deterioration of image quality such as a decrease in density, density nonuniformity, formation of blank stripes, and the like, caused by the above-mentioned variations cannot be eliminated. In particular, the variations among the nozzles are further emphasized in the above-mentioned overlapping print method.

Furthermore, although the area factor is increased, since the ink print amount per unit area corresponds to two dots, the ink cannot be absorbed in the paper sheet on a high-duty region (e.g., a print duty of 100%) on the normal paper sheet, and the problem of blurring remains unsolved.

SUMMARY OF THE INVENTION

The present invention has been made to solve the above-mentioned problems, and has as its object to provide an ink jet recording apparatus and an ink jet recording method, which can increase the print density while suppressing blurring, and can eliminate density nonuniformity.

It is another object of the present invention to provide an ink jet recording apparatus and method, which can efficiently increase the density with a small ink ejection amount.

It is still another object of the present invention to provide an ink jet recording apparatus, which can effectively emphasize black.

In order to achieve the above objects, according to the present invention, an ink jet recording apparatus comprising a multi head for ejecting ink droplets from a plurality of multi nozzles, comprises paper feed means for performing a paper feed operation by a width not less than one pixel in addition to an integer multiple number of pixels with respect to basic pixels inherent to the ink jet recording apparatus, and ejection means for performing a plurality of times of ink ejections, so as to have ink landing points within a distance less than one pixel at a density of the pixels, before and after the paper feed operation by the paper feed means for a single pixel region. According to this apparatus, a variation in ink surface density on a recording sheet in an overlapping print method is reduced to efficiently increase the image density, and to promote absorption and evaporation of an ink to and from the sheet, thereby suppressing blurring.

In order to achieve the above objects, according to the present invention, there is provided an ink jet recording apparatus comprising a recording head for ejecting an ink from a plurality of ejection orifices to a recording medium, wherein a plurality of times of ink ejections are performed for one-pixel regions of basic pixels inherent to said ink jet recording apparatus, and at least one of the plurality of times of ink ejections has a smaller ink ejection amount than the remaining times of ink ejections. According to this method, the area factor can be increased efficiently, i.e., with a small ink print amount per unit area, thereby increasing the density.

BRIEF DESCRIPTION OF THE DRAWINGS

FIGS. 18A and 18B show PWM control tables;

DETAILED DESCRIPTION OF THE PREFERRED EMBODIMENTS

The preferred embodiments of the present invention will be described below with reference to the accompanying drawings.

(First Embodiment)

Figure 4A:
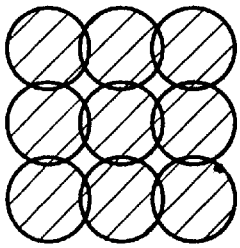
FIGS. 4A to 4D are views for explaining ink landing states according to a print method of the present invention.
Figure 4B:
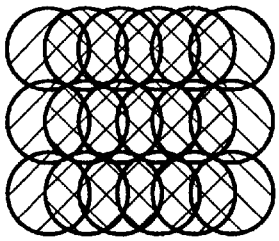
Figure 4C:
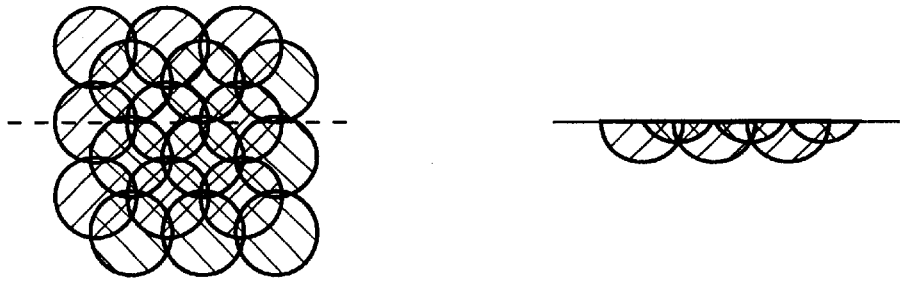

As the first embodiment, a "two-pass emphasis print method" will be described below. FIGS. 4A to 4C are views for explaining dot printed states of this embodiment. FIGS. 4A and 4B show conventional printed states, and FIG. 4C shows a printed state of this embodiment. In this case, all the four color inks, i.e., cyan, magenta, yellow, and black inks, are printed by the print method shown in FIG. 4C so as to increase the densities of all the ink colors. In order to print dots while shifting landing positions by a ½ pixel in the main and sub scanning directions, a paper feed operation in units of a ½ pixel with respect to a pixel density is required in addition to regular printed dot landing points. As for the main scanning direction, the print timing is shifted by only a ½ pixel like in the prior art, thus realizing a ½ pixel shift print operation.

Figure 1:
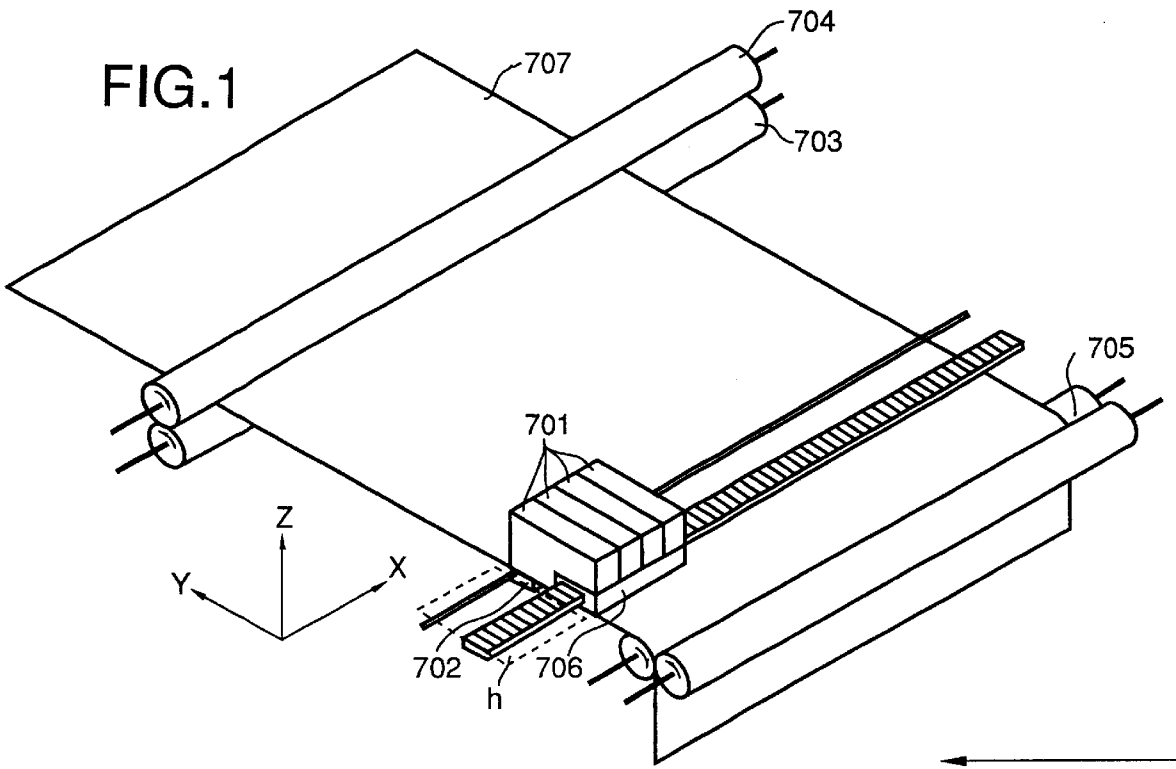
FIG. 1 is a perspective view showing a printer unit of an ink jet printer to which the present invention is applied.

In the paper feed operation of this embodiment, a paper feed operation by (n/2+½) pixels and a paper feed operation by (n/2−½) pixels with respect to the number n of nozzles (in this embodiment, n=64) are alternately performed by a paper feed roller 703 shown in FIG. 1. As a method of performing such paper feed operations, the following means may be proposed.

Figure 5:
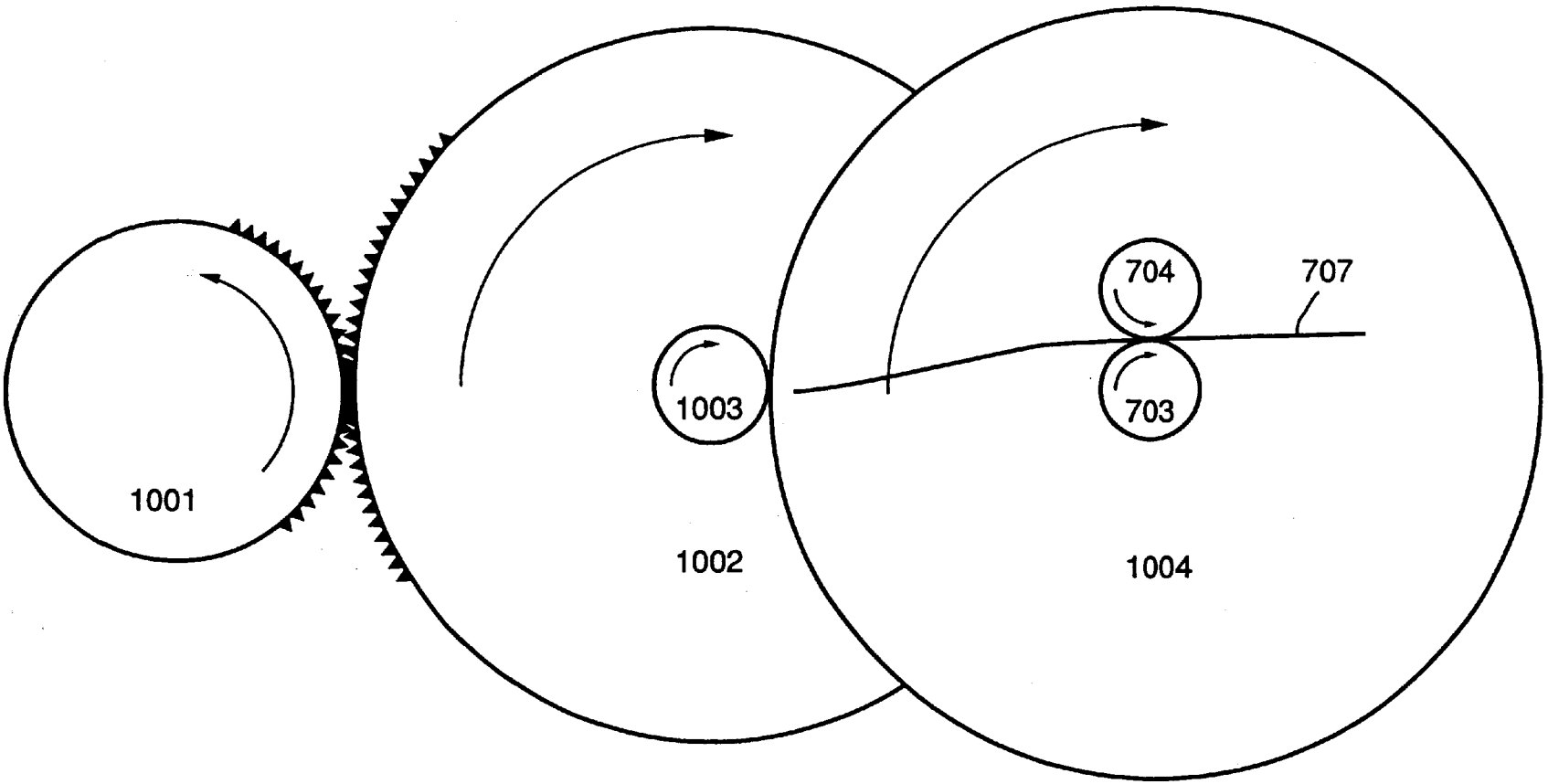
FIG. 5 is a view showing a driving operation of a paper feed roller for realizing the present invention under the electrical control.

FIG. 5 shows a method of realizing two different paper feed pitches under the electrical control of the rotational speed of a paper feed driving motor using two gears and three rollers. Note that an ink jet printer used in this description has a dot density of 360 dpi, and a pixel pitch of about 70.5 μm. In FIG. 5, a gear 1001 directly coupled to a paper feed motor (not shown) rotates a gear 1002 having a pitch corresponding to 50 pixels (about 3,528 μm) and a reduction ratio of 1/10, and the paper feed roller 703. The diameter ratio of the paper feed roller 703 to a gear 1004 is also 1/10. When the gear 1001 is rotated by one pitch by the number of pulses corresponding to a given integer m, the paper feed roller 703 feeds a paper sheet by a ½ pixel. Therefore, when a signal (m pulses) corresponding to one pitch is supplied to the gear 1001, the paper sheet is fed by a ½ pixel.

As described above, when a paper sheet is to be fed alternately by (n/2+½) pixels and by (n/2−½) pixels using the multi head having n multi nozzles, 2m*(n/2+½) pulses and 2m*(n/2−½) pulses need only be alternately supplied to the driving motor directly coupled to the gear 1001. When only a paper feed mode for feeding a paper sheet by alternately increasing and decreasing an amount less than one pixel is available, feed amount control may be realized by mechanical means shown in FIG. 6.

Figure 6:
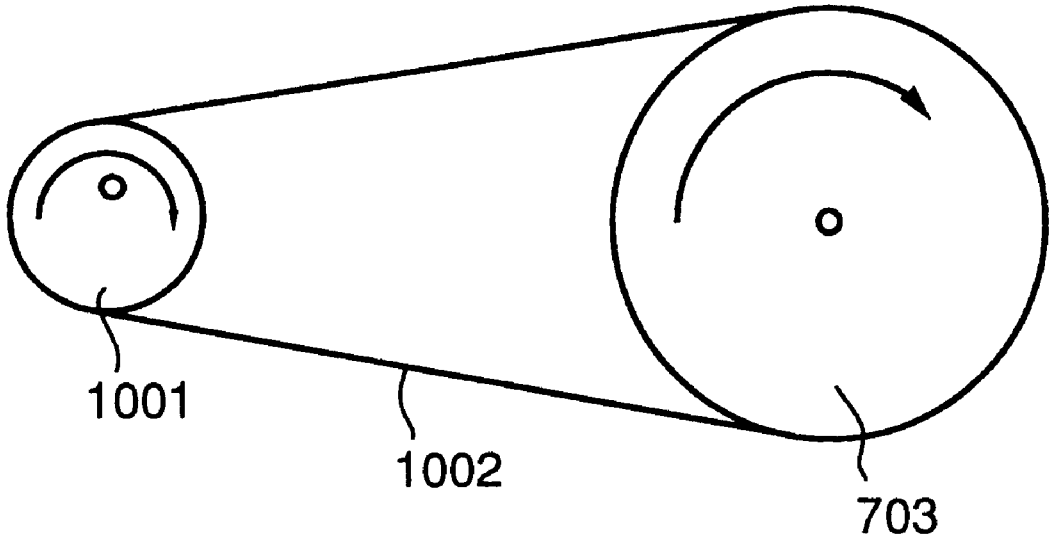
FIG. 6 is a view showing a driving operation of a paper feed roller for realizing the present invention under the mechanical control.

FIG. 6 shows a feed amount adjustment unit assembled in a paper feed driving transmission mechanism. In this mechanism, an eccentric gear is rotated by a belt. In FIG. 6, an eccentric gear 1101 cooperates the paper feed roller 703 through a belt 1102. When the eccentric gear 1101 completes one revolution, the paper feed roller is fed by one pixel. Thus, the eccentric gear is always rotated by (k+½) revolutions from a predetermined position to feed a paper sheet.

According to this mechanism, since a paper feed amount less than one pixel, which is alternately increased and decreased, can be desirably set by changing the rotation initial position of the eccentric gear, an increment/decrement can be controlled according to a recording medium. For this reason, characteristics such as an increase in line width, painting of fine portions, and the like, which are slightly deteriorated by this embodiment, and characteristics such as an increase in density, blank stripes, and the like, can be easily set according to paper sheets.

When the means described above with reference to FIGS. 5 and 6 are used, a paper feed operation by a ½ pixel can be performed, and a dot can land at a position to be separated by a ½ pixel in the vertical and horizontal directions from a regular landing point so as to overlap a dot at the regular landing point.

Figure 7:
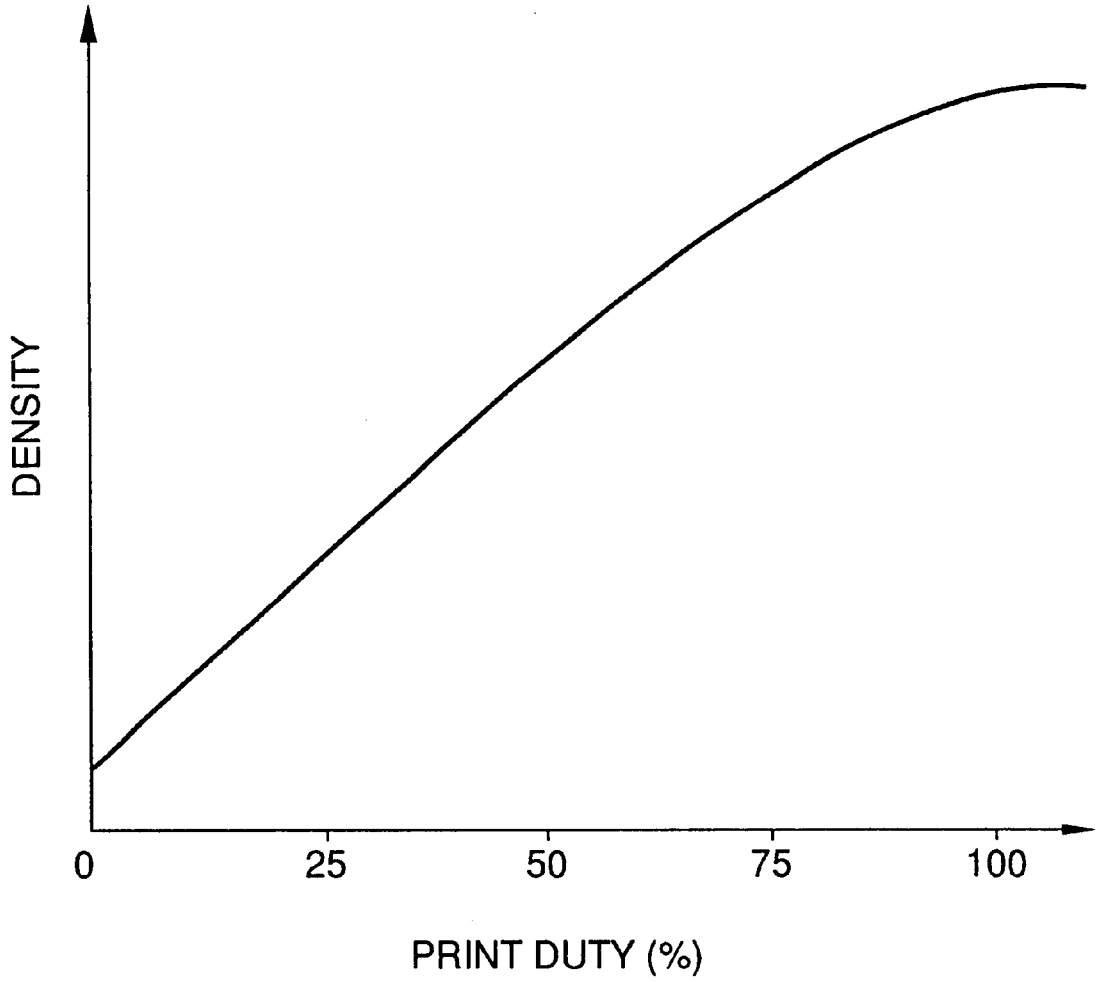
FIG. 7 is a graph showing the relationship between the print duty per unit area and the density.

The reason why the density on a normal paper sheet can be efficiently increased using the above-mentioned print method will be explained below with reference to FIG. 7 and FIGS. 8A and 8B. In FIG. 7, a print duty (the ratio of the number of printed dots in a unit region including a sufficient number of printed pixels) is plotted along the abscissa, and the density of the region is plotted along the ordinate. As can be seen from FIG. 7, in a print density curve, the density is increased almost proportionally to the print duty at the low print duty side. However, the inclination of the print density curve is gradually decreased toward the high duty side. While dots are printed in a unit region without overlapping each other, the number of dots largely influences the ratio of a printed region in the unit region, and hence, the inclination of the increase in density is large. However, when the print duty is increased so that dots overlap each other, the overlapping portion of the two dots has a small influence on the print density as compared to a case wherein one dot is printed on a blank sheet.

More specifically, when the density is to be efficiently increased without blurring, a method of efficiently increasing the area factor of printed dots must be employed.

Therefore, the method of printing dots at positions separated by a distance less than one pixel like in this embodiment can attain a higher density than in the conventional method of printing dots at the same position to overlap each other so as to increase the print density. Furthermore, in this case, when dots land at positions shifted by half a pixel, the density can be most increased. As described above, this means is particularly effective at a low duty. However, this means is also sufficiently effective at a high duty at which most of pixels are printed adjacent to each other.

Figure 8A:
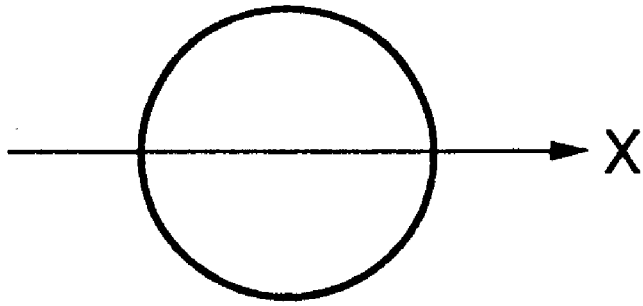
FIGS. 8A and 8B are views showing the density distribution of one dot landing point.
Figure 8B:
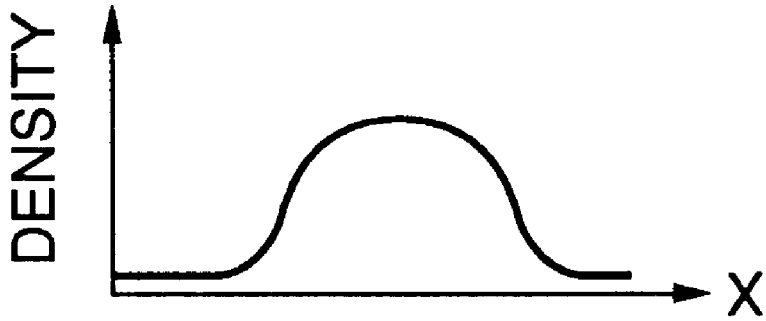

FIGS. 8A shows a state of one dot printed on a paper sheet, and FIG. 8B shows the density distribution of the dot in the x-direction. In this manner, a portion having a high density and a portion having a low density are distributed, as shown in FIG. 8B, even in one dot. For this reason, when an overlapping print operation is performed to have the center at an end portion having the lowest density in one dot, a higher density than that obtained in the conventional two-dot overlapping print method can be obtained even when the density reaches the upper limit more or less. As for a shift of the dot landing position in the y-direction caused by the inclination of multi nozzle ejection orifices, when dots each having the landing center at a position shifted by half a pixel are printed, a gap between adjacent dots, which are conspicuous as a blank stripe in the conventional method, can be eliminated, and image quality can be further improved. Furthermore, since the landing point of a dot, which is printed to overlap other dots, is shifted from the positions of already printed dots, ink dots, which are printed to overlap each other, can be quickly absorbed into the sheet surface, and the surface area of the ink on the sheet surface can be increased, thus promoting evaporation/drying of the ink. As a result, blurring with surrounding dots can be effectively prevented.

Figure 9A:
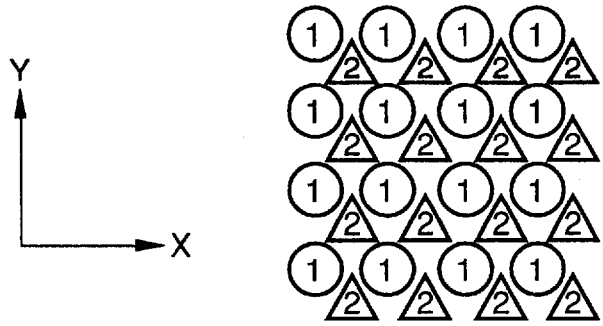
FIGS. 9A and 9B are views for explaining a print method according to the fourth embodiment of the present invention.
Figure 9B:
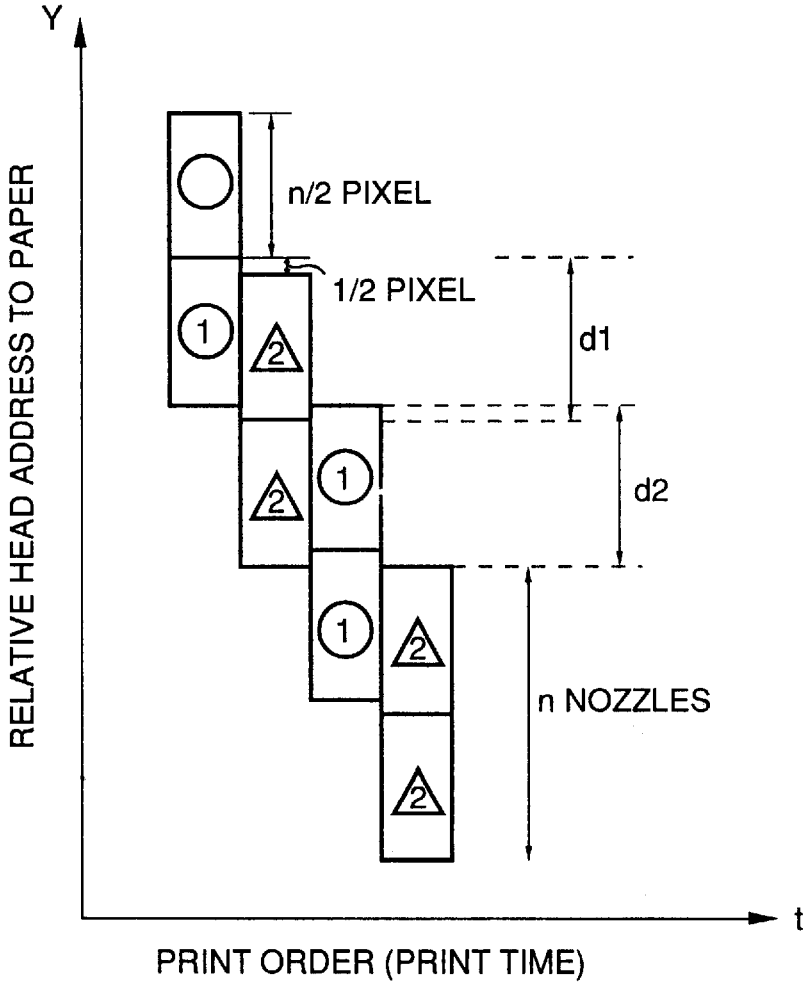

In this embodiment, a multi head is scanned twice per print region corresponding to the total width of multi nozzles so as to complete a print operation by different nozzles. For this reason, density nonuniformity on the sheet surface caused by variations in various factors in the manufacture of the multi head can be suppressed in addition to an efficient increase in density. FIGS. 9A and 9B show this print method in detail.

FIG. 9A shows a dot landing state in a given region in units of four pixels each in the vertical and horizontal directions. In FIG. 9A, 1 with ○ (to be described as ○1 hereinafter) indicates a regular dot landing point, and 2 with Δ (to be described as Δ2 hereinafter) indicates a landing central point of a dot to be printed at a position shifted by half a pixel for the purpose of emphasis. These dots ○1 and Δ2 complete one pixel print operation using the same image data. Numbers (1 and 2) written in the circle and triangle represent the print order of two overlapping dots for each pixel.

FIG. 9B expresses such a print sequence of the head level. The head address (relative position) relative to a paper sheet is plotted along the ordinate, and coincides with the y-direction in FIGS. 1 and 9A. The print time is plotted along the abscissa, thereby indicating a head position per scan relative to the paper sheet. The multi head having n multi nozzles is divided into two portions each including n/2 multi nozzles, and ○1 and Δ2 written on the head portions in FIG. 9B indicate which one of ○1 and Δ2 forming one pixel shown in FIG. 9A the respective head portions print, i.e., express that which one of dots ○1 and Δ2 the respective head portions print at corresponding timings. At this time, ○1 and Δ2 forming one pixel use the same image data in corresponding scan operations.

The print sequence will be described below along the time base (abscissa). After a paper sheet is fed, in the first scan operation, the lower half portion of each multi head prints dots ○1, and upper half nozzles do not perform a print operation. Upon completion of such a print scan operation, the paper sheet is fed by (n/2+½) pixels in the y-direction upon rotation of the paper feed roller 703 shown in FIG. 1. In this stage, paying attention to, e.g., a region having a width corresponding to (n/2+½) pixels indicated by d1 of a print start portion on the sheet surface, dots of four colors are printed on only a portion of ○1 in this region.

Then, a new scan operation is performed. In this case, the positional relationship between the multi nozzles and the sheet surface is shifted by half a pixel in a (−y)-direction from a regular state by the above-mentioned paper feed operation. In this state, upper and lower half nozzles print Δ2 using all the head portions. At this time, the print timing is shifted by a ½ pixel in the main scanning direction. Upon completion of this scan operation, dots printed in the region d1 are ○1 in four colors previously printed by the lower half portion of each head, and Δ2 in four colors presently printed by the upper half portion of each head.

The third scan operation is performed after the paper sheet is fed. At this time, the paper feed amount by the roller 703 corresponds to (n/2−½) pixels unlike in the previous paper feed operation. In this manner, the multi nozzles and the print surface can have the regular positional relationship therebetween again. Then, all the heads of four colors print ○1.

Upon completion of the third print operation, the print operations of ○1 and Δ2 landing portions are completed in the order of ○1→Δ2 in the region d1 having a width of (n+½) pixels, and are completed in the order of Δ2→○1 in a region d2 having a width of (n+½) pixels. In reconsideration of the regions d1 and d2 printed in this manner, since both ○1 and Δ2 are printed by the different, i.e., upper and lower portions of each multi head, the print habits of the individual multi nozzles are reduced, and density nonuniformity on the print surface in the nozzle aligning direction as a problem to be solved can be eliminated. In this embodiment, the overlapping print operation is performed for all the four color inks, i.e., cyan, magenta, yellow, and black inks. For example, when only black of four colors is to be emphasized, ○1 may be printed in four colors, and Δ2 may be printed in only a color to be emphasized. In this manner, the color to be emphasized can be further emphasized as compared to the remaining colors.

With the above-mentioned print method, an image which is free from density nonuniformity, and has a high emphasized color density and high image quality can be printed. In this embodiment, the paper feed amount corresponding to a ½ pixel is alternately increased and decreased. However, the paper feed amount to be increased/decreased may be set to be less than a ½ pixel in consideration of balance with paper width reproducibility and resolution. On the contrary, even when the paper feed amount of more than a ½ pixel is increased/decreased, the effect of the present invention can be expected as long as the paper feed amount to be increased/decreased is less than one pixel. When the landing point is shifted by a ½ pixel in the main and sub scanning directions, an overlapping state between ink dots, which are spread to have the landing points as the centers, can be minimized, as shown in FIG. 4C. In other words, a region where no ink is attached can be minimized, and an image having very high image quality can be printed.

(Second Embodiment)

As the second embodiment, a "four-pass fine black emphasis print method" will be described below with reference to FIGS. 4A to 4D, FIGS. 10A and 10B, and FIGS. 11A and 11B. As has already been described in the above embodiment, the dot landing state shown in FIG. 4C is also attained in this embodiment. In this embodiment, however, although four color inks, i.e., black, cyan, magenta, and yellow inks are printed using equivalent multi heads, the three color inks, i.e., cyan, magenta, and yellow inks are printed by the print method shown in FIG. 4A, and only the black ink is printed by the print method shown in FIG. 4C.

In the first embodiment, each head is divided into two portions, and the print operation is attained by two scan operations per ½ head region. However, in this embodiment, the print operation is completed by four scan operations of each multi head per ¼ print region of each multi head. This is to further effectively eliminate the density nonuniformity on the sheet surface caused by variations in various factors in the manufacture of the multi head, and blurring at a boundary between adjacent different colors as the most serious problem on a normal paper sheet.

In order to eliminate blurring at a boundary portion between adjacent different colors, a method of decreasing the number of dots, which are printed on the sheet surface at a time, and performing a plurality of times of print operations on a single region while drying the ink on the sheet surface little by little is known.

Figure 10A:
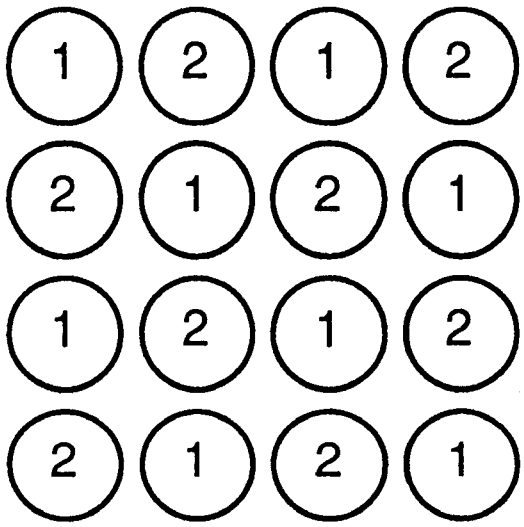
FIGS. 10A and 10B are views for explaining a multi-pass print method.
Figure 10B:
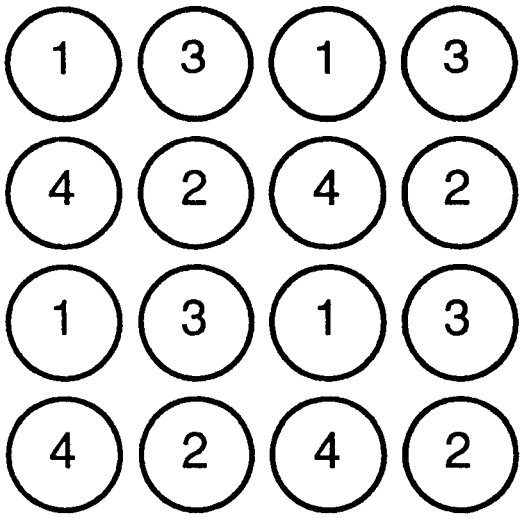

FIGS. 10A and 10B show the printed dot positions and the landing order when this method is used. FIG. 10A shows a method wherein the print operation within a predetermined region is completed by two print carriage movements, and FIG. 10B shows a method wherein the print operation within a predetermined region is completed by four print carriage movements. The numbers shown in FIGS. 10A and 10B indicate the numbers of order of the scan operations for printing the corresponding landing points. In FIGS. 10A and 10B, the positions having the same numbers are determined so that when they are printed at the same time, they are present at separate positions as much as possible. With this print operation, even when the print operation is performed on a normal paper sheet at a high duty, an ink can be prevented from simultaneously attaching and overflowing at the same position, thus eliminating blurring.

However, since to increase the density by increasing the ink amount and to eliminate blurring use operations opposite to each other, when the above-mentioned two methods are simply independently executed, the problems to be solved contradict with each other. More specifically, when the print amount of the black ink is increased, the problem of blurring is inevitably posed. When a single region is printed by several times of print operations, the temperature of each multi head is decreased as compared to a normal print operation, and the ink amount per ejection is decreased, resulting in a decrease in density.

Thus, a method of performing an overlapping print operation using only the multi head of the black ink while a single region is printed by several times of print operations has already been proposed. In this manner, the print density can be increased without causing blurring at a boundary between adjacent different colors. In this embodiment, the present invention is also applied upon execution of this method, thereby obtaining another effect.

Figure 11A:
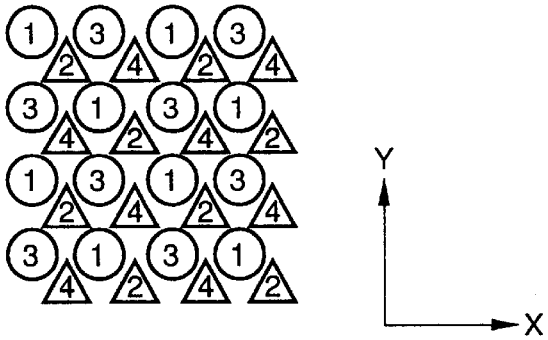
FIGS. 11A and 11B are views for explaining a print method according to the fifth embodiment of the present invention.
Figure 11B:
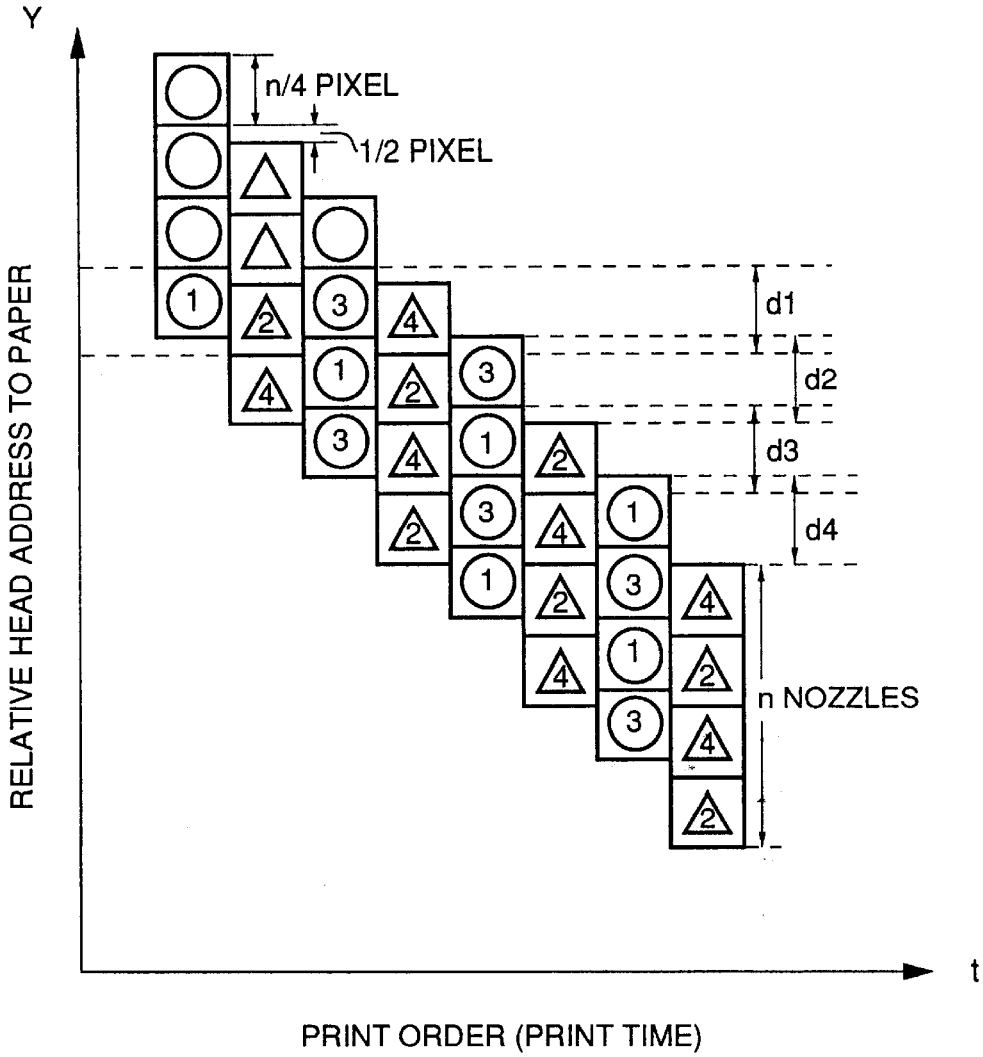

FIGS. 11A and 11B show the print method of this embodiment in detail like in FIGS. 9A and 9B of the first embodiment. In FIG. 11A, ○1 and ○3 indicate regular dot landing points, which are target points as landing centers of all the multi heads of four colors, i.e., cyan, magenta, yellow, and black. On the contrary, Δ2 and Δ4 indicate landing points shifted by half a pixel, which are target points as the landing central points of only the black multi head for the purpose of emphasis. FIG. 11A shows the arrangement of printed dots in a given region. In FIG. 11A, dots having the same number are printed in a single scan operation, but are not always printed in the order of numbers. This arrangement is determined so that adjacent dots are not printed at the same time but dots printed at the same time are distributed widely, and printed dots overlap each other while being dried little by little.

FIG. 11B shows the print sequence of the head level. In FIG. 11B, the head address relative to a paper sheet is plotted along the ordinate, and coincides with the y-direction in FIG. 11A. The print time is plotted along the abscissa to indicate which of dots ○1, Δ2, ○3, and Δ4 four ¼ portions of each multi head having n multi nozzles print at the corresponding timings. In this case, ○1 and Δ2 or ○3 and Δ4 forming one pixel use the same data in a corresponding scan operation.

The print sequence will be described below along the time base (abscissa). After a paper sheet is fed, in the first scan operation, 3n/4 nozzles of the four divided portions counted from the distal end portion of each multi head, i.e., from a portion closest to the end portion of the paper sheet do not perform a print operation. Only the remaining n/4 nozzles print ○1. Upon completion of this print scan operation, the paper sheet is fed by (n/4+½) pixels in the y-direction. As the paper feed driving method, the method shown in FIGS. 5 or 6 described in the first embodiment is used. In this stage, paying attention to, e.g., a region having a width corresponding to (n/4+½) pixels indicated by d1 of a start portion of the print region on the sheet surface, dots of four colors are printed on only a portion of ○1 in this region.

Then, a new scan operation is performed. In this case, the positional relationship between the multi nozzles and the sheet surface is shifted by half a pixel in a (−y)-direction from a regular state by the above-mentioned paper feed operation. In this state, only the black head performs a print operation. At this time, the upper two portions of the four divided portions of the multi head, i.e., n/2 nozzles do not perform the print operation. Of the remaining two portions, the upper portion prints Δ2, and the lower portion prints Δ4. Upon completion of this scan operation, dots printed in the region d1 are four-color dots ○1 printed in the previous scan operation, and black dots Δ2 printed in the current scan operation. On a region d2 having the same width as the region d1 and present therebelow, only black dots Δ4 are printed.

The third scan operation is performed after the paper sheet is fed. At this time, the paper feed amount is set to be (n/4−½) pixels unlike in the previous paper feed operation. In this manner, the multi nozzles and the print surface can have the regular positional relationship again. Using all the heads of four colors, n/4 nozzles corresponding to the uppermost portion do not perform a print operation, and the remaining three portions perform a print operation in the order of ○3, ○1, and ○3. In this stage, dots printed on the region d1 are dots ○1, Δ2, and ○3, dots printed on the region d2 are dots Δ4 and ○1, and dots printed on a region d3 below the region d2 are dots ○3.

Then, the paper sheet is fed by (n/4+½) pixels again, so that the head and the sheet surface have the positional relationship shifted by half a pixel again. Only the black head performs a print operation in the order of Δ4, Δ2, Δ4, and Δ2 in units of ¼ nozzles from the upper portion. Upon completion of this scan operation, the print operations of all the landing portions ○1, Δ2, ○3, and Δ4 are completed on the region d1, dots Δ4, ○1, and Δ2 are printed on the region d2, dots ○3 and Δ4 are printed on the region d3, and dots Δ2 are printed on a region d4 below the region d3.

By another paper feed operation by (n/4−½) pixels, the multi heads are moved to a position separated from this region, and the region d2 is completed this time. When such print operations are repeated, dots shown in FIG. 11A land in the order from the left side of each region shown in FIG. 11B, that is, in the order of ○1→Δ2→○3→Δ4 on the region d1, in the order of Δ4→○1→Δ2→○3 on the region d2, in the order of ○3→Δ4→○1→Δ2 on the region d3, and in the order of Δ2→○3→Δ4→○1 on the region d4.

Paying special attention to the region d1 printed in this manner, the next print operation of cyan, magenta, and yellow dots is performed after an elapse of a time interval corresponding to one scan operation. This time interval is long enough to cause the ink to penetrate into the sheet surface. Therefore, boundary blurring can be prevented, and improvement of image quality can be expected. Since ○1, Δ2, ○3, and Δ4 are printed using different portions of the multi head, the print habits of the individual multi nozzles are reduced, and density nonuniformity on the print surface in the nozzle aligning direction as a problem to be solved can be eliminated. In this manner, the print and paper feed operations are repeated according to FIG. 11B.

The following phenomenon may occur depending on the ejection amount and balance between blurring and the density. When the method of this embodiment is executed, the black density can have a sufficient value. However, since the ink print amount is as high as 200% of the normal amount, blurring may slightly worsen. In this case, a method of decreasing the ejection amount per dot of the black ink as compared to the remaining colors may be employed. As a method of decreasing the ejection amount, the head itself may be changed by, e.g., adjusting the size of the ejection orifices of the multi nozzles, or the driving method may be changed by, e.g., decreasing the driving pulse width or by decreasing the head temperature for only the black ink multi head. In this manner, the black ink is printed little by little in an ink amount larger than other color inks, thus effectively solving the above-mentioned problem.

In this case, a method of further increasing the number of print passes is also available. However, with this method, when the number of nozzles is not so large, time cost is undesirably increased. Contrary to this, the method of decreasing the ejection amount can reduce overflow of the ink at black landing points, can prevent blurring of the black ink to a surrounding portion, and can obtain a sufficient density. As a result, an image with high image quality can be obtained. Furthermore, when the ejection amount is decreased, the consumption amount of an ink to be emphasized can be maintained not to be largely different from the consumption amounts of other inks.

With the above-mentioned print method, a high-quality image, which is free from density nonuniformity and boundary blurring, and has a high black density, can be printed within a short period of time.

(Third Embodiment)

As the third embodiment, an "eight-pass fine black emphasis print method" will be described below. This method is a further extended one of the "four-pass fine black emphasis print method" of the second embodiment in consideration of further elimination of blurring as compared to the second embodiment.

Figure 12A:
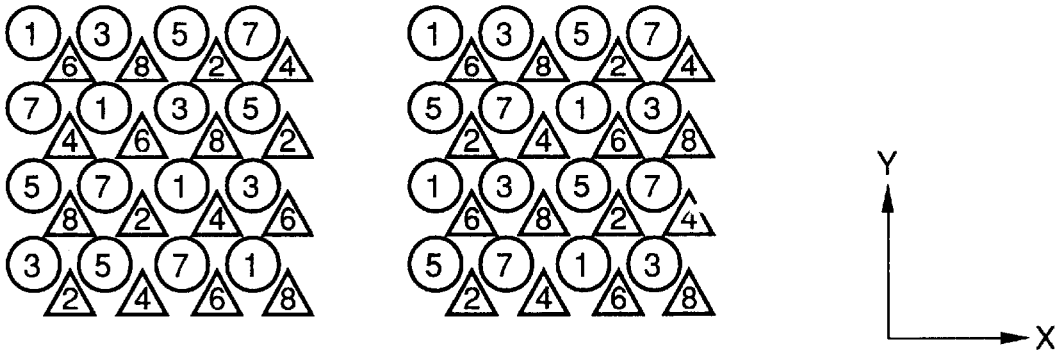
FIGS. 12A and 12B are views for explaining a print method according to the sixth embodiment of the present invention.
Figure 12B:
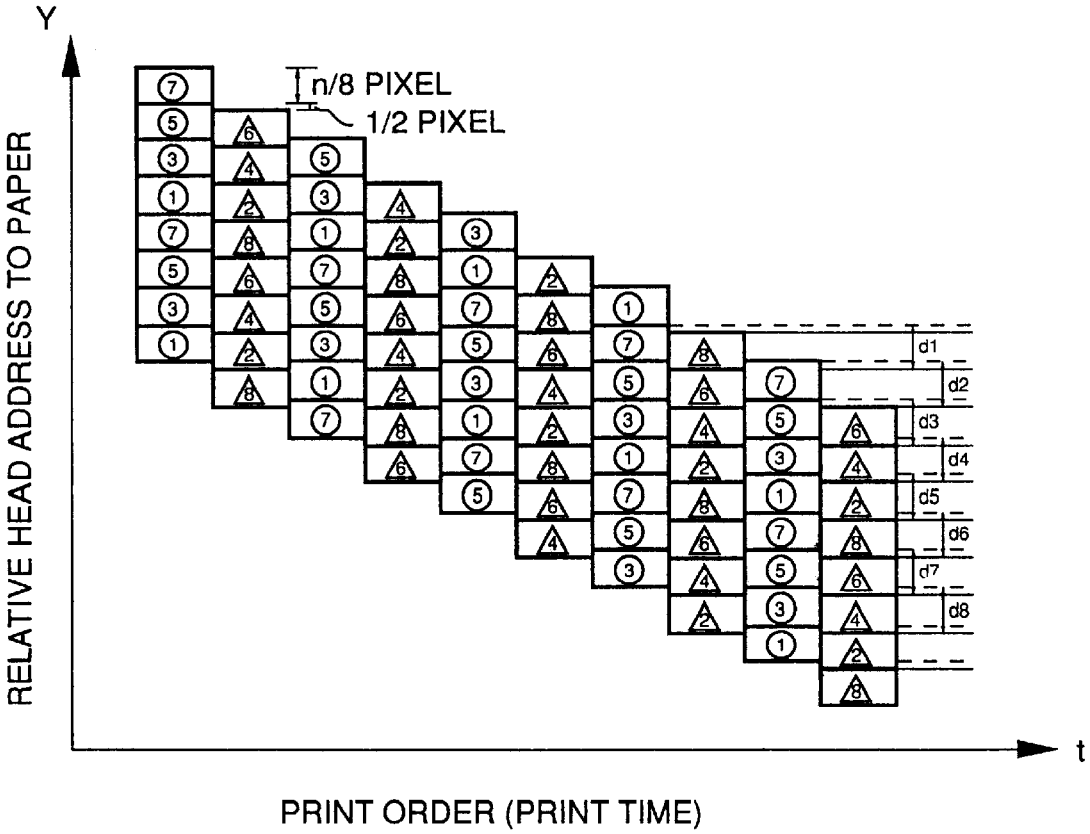

FIGS. 12A and 12B correspond to FIGS. 11A and 11B of the second embodiment. In FIG. 12A, ○1, ○3, ○5, and ○7 indicate regular dot landing points, which are target points as the landing centers of all the equivalent multi heads of four colors, i.e., cyan, magenta, yellow, and black. Contrary to this, Δ2, Δ4, Δ6, and Δ8 indicate positions shifted by a ½ pixel, which are target landing central points of only the black head. Like in the second embodiment, in the print regions shown in FIG. 12A, ○1 to Δ8 represent that landing points having the same number are printed in a single scan operation. At this time, dots ○ and Δ forming one pixel use the same data in the corresponding scan operation.

In FIG. 12A(left), this arrangement is determined so that dots Δ2, Δ4, Δ6, and Δ8 for black emphasis and dots ○1, ○3, ○5, and ○7 adjacent thereto are printed to gradually overlap each other at shifted print times and at distributed positions. In particular, this is based on the idea for preventing blurring of the black ink with other colors, which may occur upon emphasis of black. On the other hand, FIG. 12A(right) shows a print method that preferentially considers an increase in distance between dots (○1 and ○1, Δ2 and Δ2, . . . ) to be simultaneously printed as compared to the method shown in FIG. 12A(left). In this print method, blurring prevention is equivalently considered for all the four colors. One of these two methods may be selected depending on the ejection amount design or a blurring state under the influence of the inks and paper sheets used. Various other proper methods may be employed in addition to these two print methods.

FIG. 12B shows a print sequence of the head level like in the second embodiment. In this embodiment, a paper sheet is fed in the y-direction by a width corresponding to the number of nozzles obtained by equally dividing the number n of nozzles of the multi head with 8, i.e., by (n/8+½) pixels or by (n/8−½) pixels. Therefore, on regions d1 to d8 each having a width of (n/8+½) pixels, dots are formed by eight scan operations of the multi heads using eight different nozzle portions. Since dots are formed at distributed positions on unit regions using eight different nozzle portions, the print habits of the nozzles can be further reduced as compared to the four-pass print method of the second embodiment, and blurring can be further suppressed, thus obtaining a high-quality image.

Since the multi head is scanned eight times, this embodiment is particularly effective for an ink jet recording apparatus having a multi head whose number n of nozzles is large, as compared to the second embodiment.

A control arrangement for executing recording control of the respective units of the apparatus will be described below with reference to the block diagram shown in FIG. 13. A control circuit shown in FIG. 13 includes an interface 10 for receiving a recording signal, an MPU 11, a program ROM 12 for storing a control program executed by the MPU 11, a dynamic RAM 13 for storing various data (the recording signal, recording data to be supplied to the head, and the like), and a gate array 14 for performing supply control of recording data to a recording head 18. The gate array 14 also performs data transfer control among the interface 10, the MPU 11, and the RAM 13. The control circuit also includes a carrier motor 20 for driving the recording head 18, a paper feeding motor 19 for feeding a recording paper sheet, a head driver 15 for driving the head, and motor drivers 16 and 17 for respectively driving the paper feeding motor 19 and the carrier motor 20. Note that the recording head 18 for only one color is shown.

Figure 13:
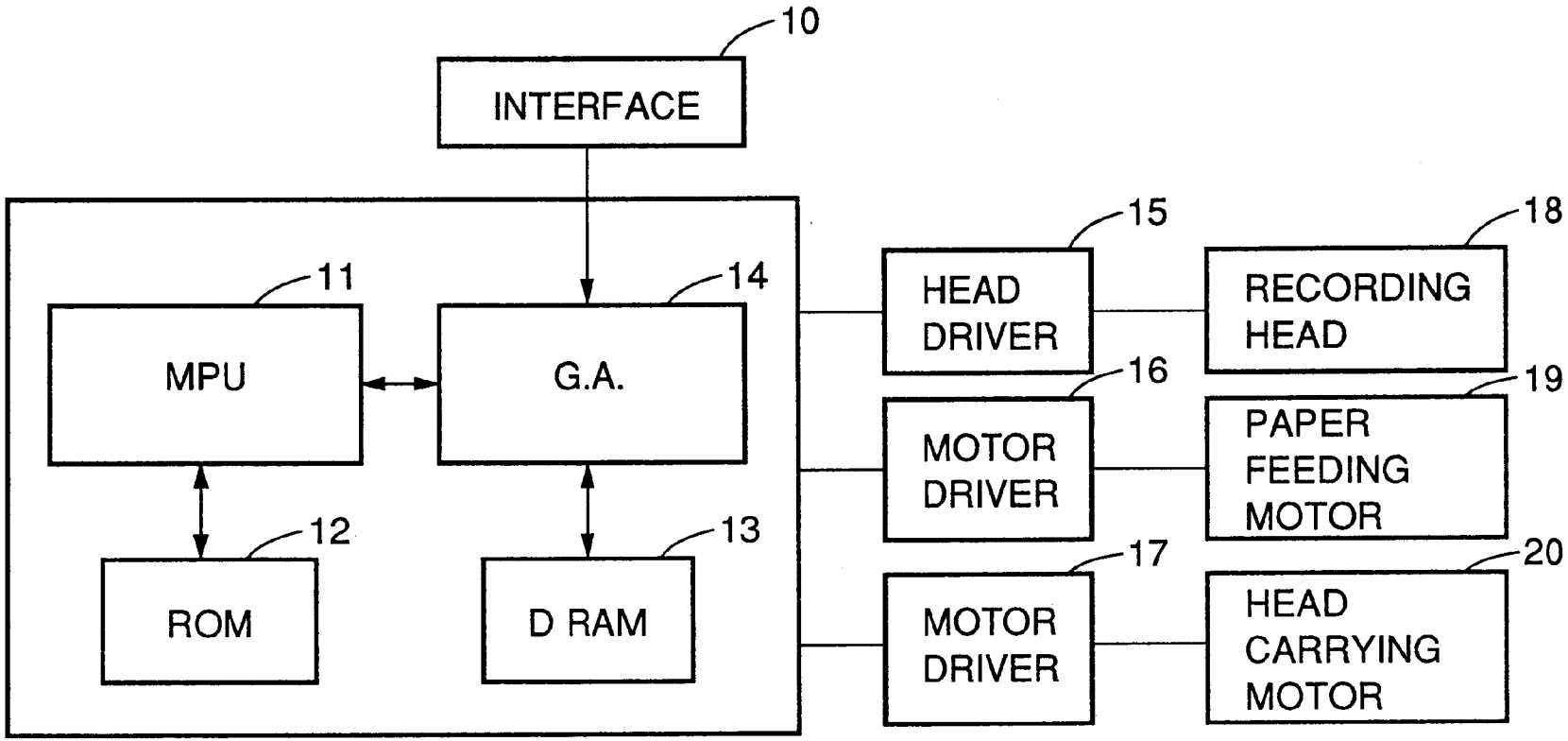
FIG. 13 is a block diagram showing a control circuit used in the third embodiment.
Figure 14:
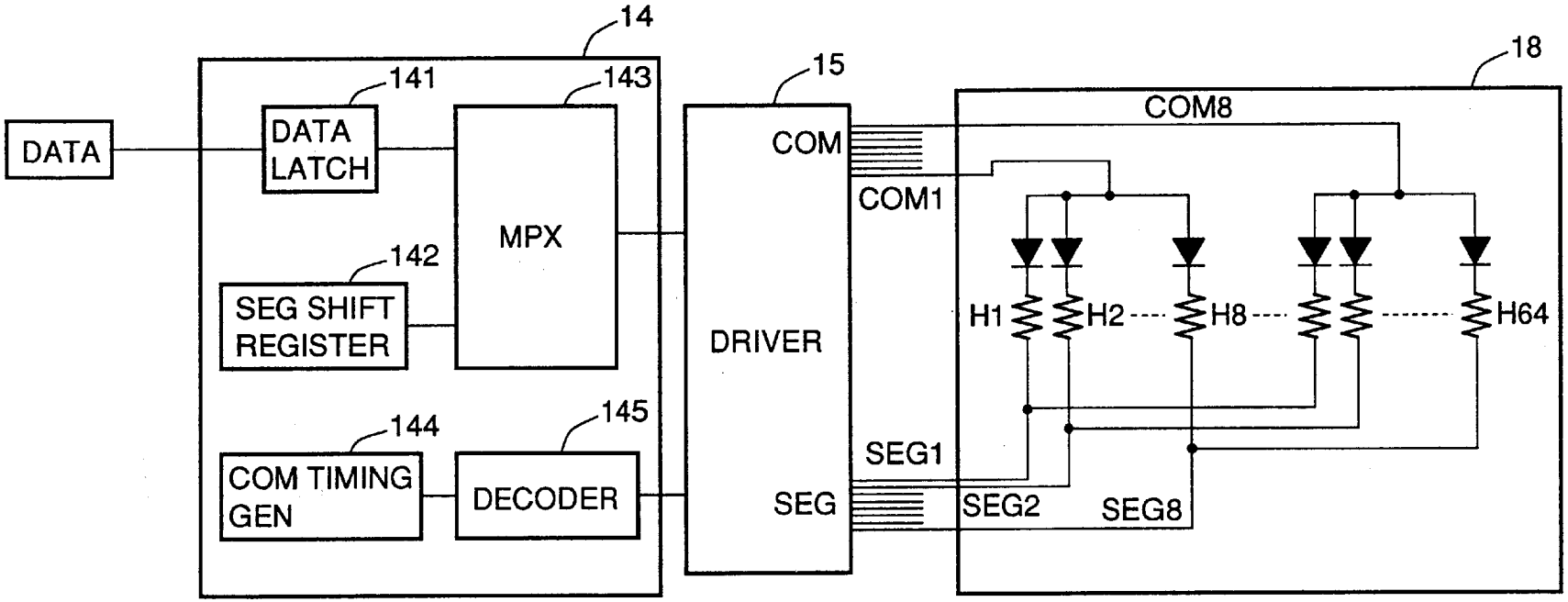
FIG. 14 is a circuit diagram showing details of the respective units shown in FIG. 13.

FIG. 14 is a circuit diagram showing the details of the respective units shown in FIG. 13. The gate array 14 has a data latch 141, a segment (SEG) shift register 142, a multiplexer (MPX) 143, a common (COM) timing generator 144, and a decoder 145. The recording head 18 has a diode matrix arrangement. More specifically, a driving current flows through an ejection heater (H1 to H64) at a position where a common signal COM and a segment signal SEG coincide with each other. Upon supply of this current, the ink is heated and ejected.

The decoder 145 decodes a timing generated by the common timing generator 144, and selects one of common signals COM1 to COM8. The data latch 141 latches recording data read out from the RAM 13 in units of 8 bits. The multiplexer 143 outputs the latched data as segment signals SEG1 to SEG8 according to the segment shift register 142. The output from the multiplexer 143 can be variously changed according to the content of the shift register 142. Thus, the print operations shown in FIGS. 11A to 12C, and the like can be performed.

The operation of the control arrangement will be described below. When a recording signal is input to the interface 10, the recording signal is converted into recording data between the gate array 14 and the MPU 11. The motor drivers 16 and 17 are driven, and the recording head is driven according to the recording data supplied to the head driver 15, thus performing the print operation. The recording data varies depending on the above-mentioned print mode.

As described above, when a paper sheet is fed by an amount less than one pixel, dots can land at positions shifted by the amount less than one pixel from the regular print landing points in the paper feed direction. Thus, blurring can be efficiently prevented as compared to the conventional method, density nonuniformity caused by individual nozzles can be prevented, and the density can be increased. Therefore, an image with higher image quality can be obtained.

(Fourth Embodiment)

Figure 4D:
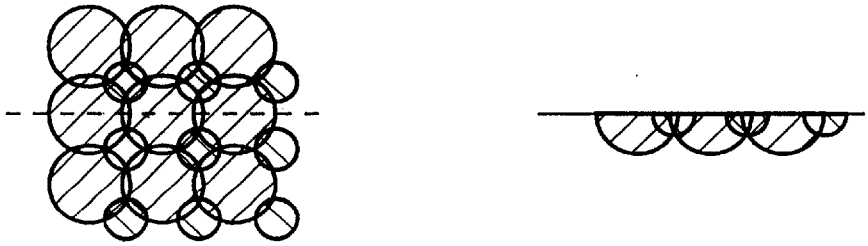

The improvement of the "two-pass emphasis print method" described in the first embodiment will be described below. FIG. 4C shows the printed state of the first embodiment, and FIG. 4D shows the printed state of this embodiment in comparison with FIG. 4C. In this case, all the four colors, i.e., cyan, magenta, yellow, and black are printed by the print method shown in FIGS. 4C or 4D, so that the densities of all the ink colors are increased. The method of performing the print operation by shifting landing positions by a ½ pixel in the main and sub scanning directions is the same as that in the first embodiment, and a detailed description thereof will be omitted.

Figure 15:
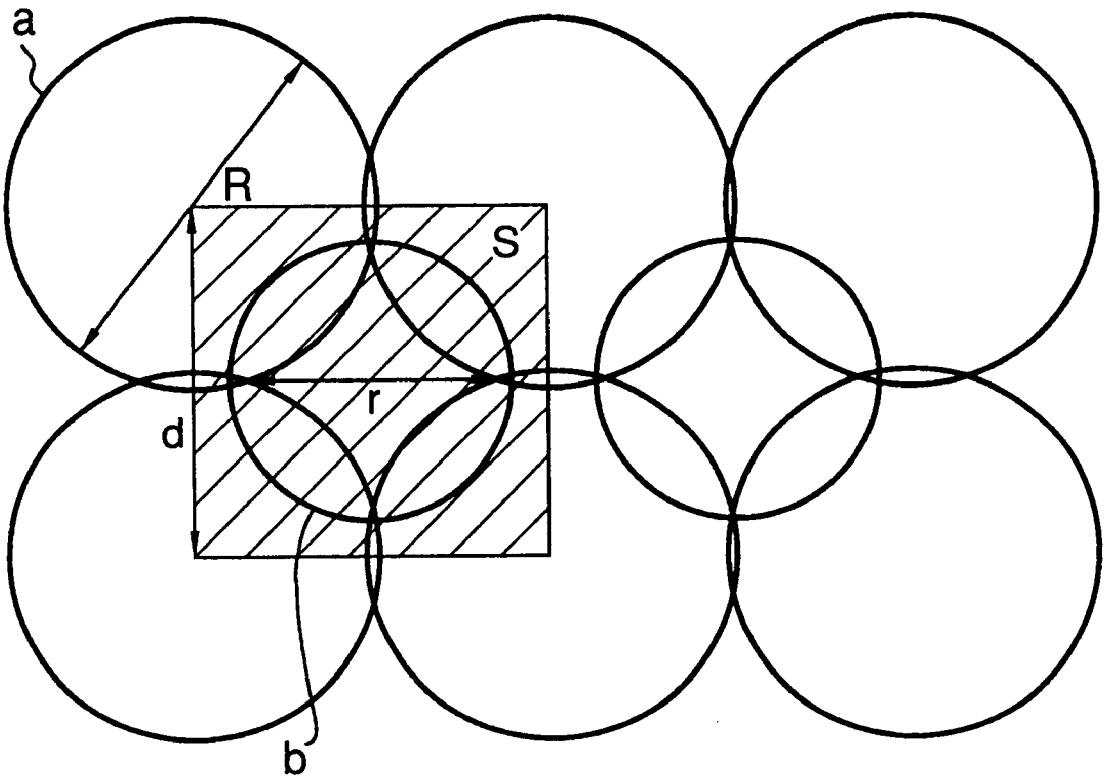
FIG. 15 is a view showing an ink landing state according to the print methods of the fourth to sixth embodiments.

The characteristic feature of this embodiment is that the area of the second dot is designated to be smaller than that of the first dot, as shown in FIG. 4D. FIG. 15 best illustrates this embodiment, i.e., shows the state of FIG. 4D in more detail. In FIG. 15, R is the dot diameter of a dot a printed at a basic landing point, and r is the dot diameter of a dot b printed at a landing point shifted by a ½ pixel each in the x- and y-directions. The dots a and b form one pixel in combination, and when the dot a is printed, the dot b is inevitably printed. d indicates the distance of one pixel, which corresponds to about 70.5 μm at a pixel density of 360 dpi. The dot diameter r is designed to form a circle which passes an intersection between two adjacent dots a printed at a pitch of the distance d. In this case, an ink amount S printed per unit area is calculated as follows using a blurring rate k of a paper sheet.

In an area s of one pixel indicated by hatching, one dot a and one dot b are printed. According to the dot diameter of the dot a, an ink amount necessary for printing this dot is given by the following formula using the blurring rate k:

$$4\pi/3*(R/2k)^3$$

As for the dot b, the necessary ink amount is given by:

$$4\pi/3*(r/2k)^3$$

Therefore, since an ink amount printed on the hatched portion s is given by:

$$4\pi/3*((R/2k)^3+(r/2k)^3)$$

then, the ink print amount S printed per unit area is obtained by dividing it with an area $d^2$ of s:

$$S=4\pi/3*((R/2k)^3+(r/2k)^3)/d^2$$

Since the circumference of the dot b passes the intersection between the two dots a, r can be expressed as a function of R using R and d as follows:

$$r=d/2-((R/2)^2-(d/2)^2)^{1/2}$$

Therefore, the print amount S can be expressed as a function of R if constants d and k are determined. Note that the range of R is expressed as follows under a condition that the adjacent dots a have an intersection, and diagonal dots a have an intersection:

$$d\leqq R\leqq\sqrt{2}d$$

Figure 16:
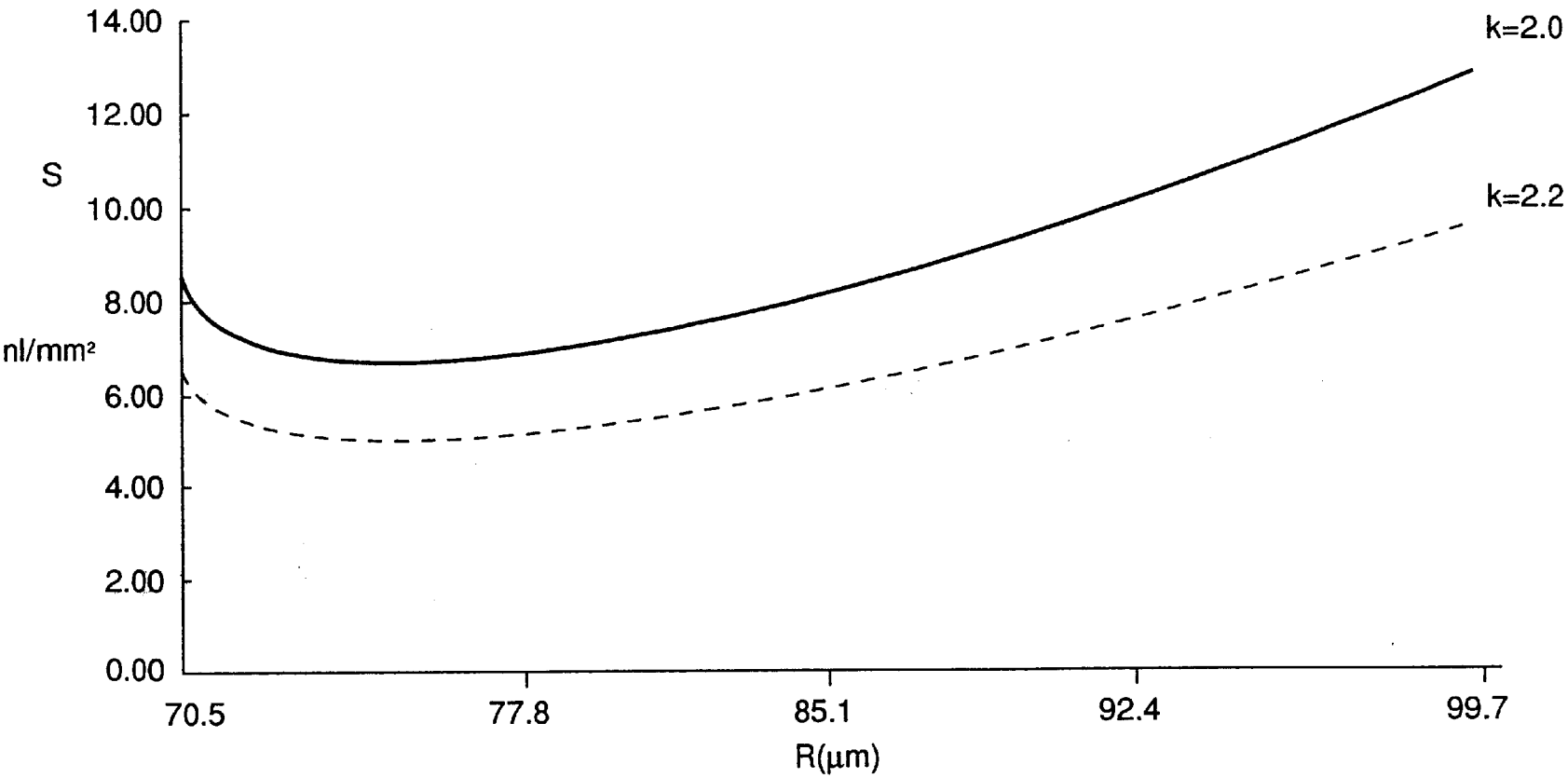
FIG. 16 is a graph showing the relationship between a dot diameter R and an ink print amount S in association with two blurring rates.
Figure 17:
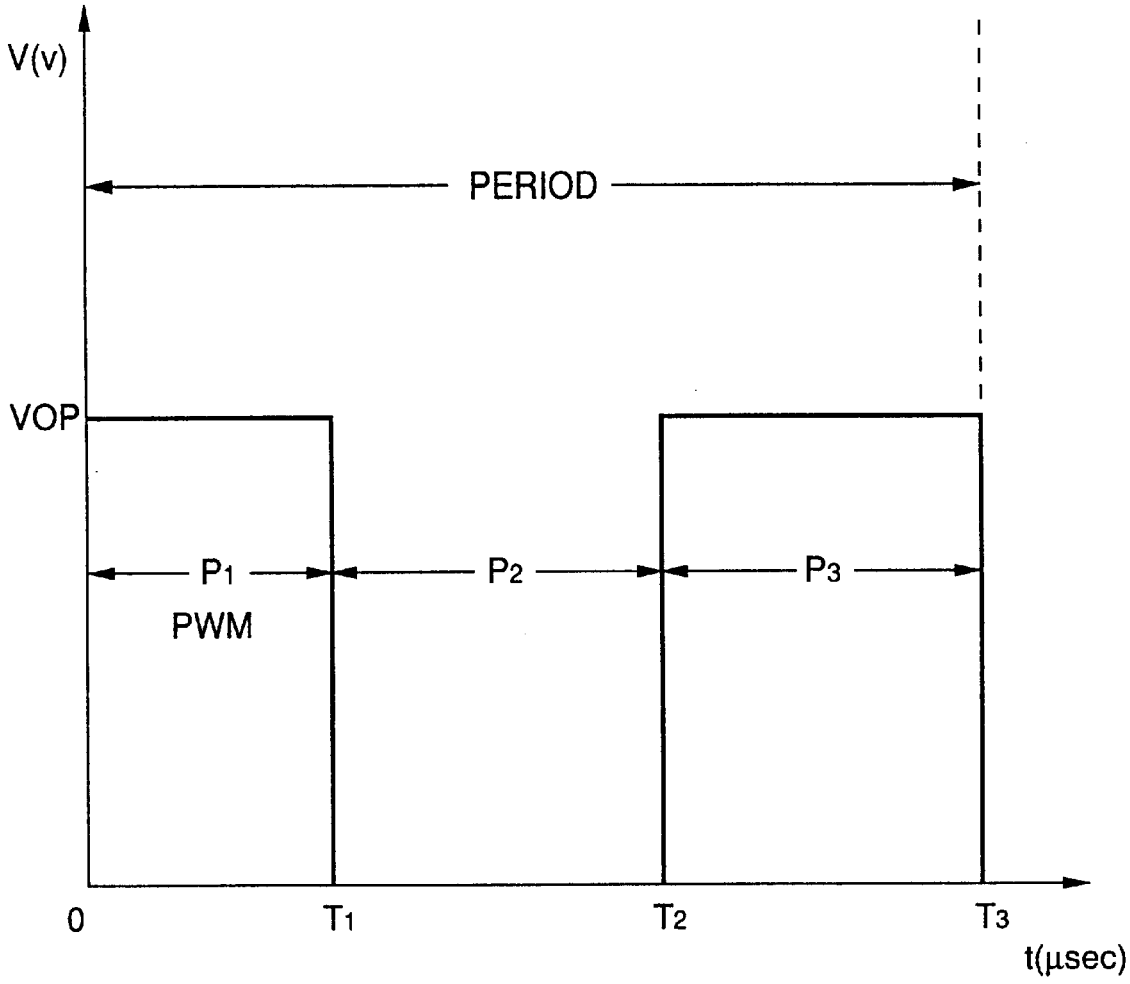
FIG. 17 is a graph showing an ejection amount setting state under the PWM control.

FIG. 16 is a graph showing the relationship between R and S when d is assumed to be 70.5 μm corresponding to 360 dpi, and k is calculated using the blurring rates max=2.0 and min=2.2. This graph expresses the dot diameter of the basic landing point when the area factor=100% is constant, and the ink print amount onto a paper sheet at that time. As can be seen from FIG. 16, when R is about 75 μm, S assumes a minimum value. When the area factor remains the same, the ink print amount is preferably as small as possible like the above-mentioned value to eliminate blurring. For example, when R is set to be about 75.2 μm, the ink print amount assumes a minimum value S=6.75 when the blurring rate k=2.0. At this time, the dot diameter r of the dot b becomes 44.5 μm, and the ejection amounts necessary for printing the dots a and b are respectively 27.93 pl/dot and 5.69 pl/dot.

Therefore, when the two kinds of ejection amount design are performed under the above-mentioned condition, an area factor of 100% can be satisfied with the highest efficiency in a blurring free state. However, the ejection amount per dot that can be ejected from the multi head is limited, and it is expected that too small a value like that of the dot b cannot attain stable ejection. In this case, even when the ink print amount S is not a minimum value, the ejection amount can be selected from a value near the minimum value. With this method, the ink print amount can be sufficiently decreased, and the range of the ejection amount can be widened. Thus, a region capable of stably printing two types of dots can be selected.

When the ejection amount design is performed, the ejection amount corresponding to the smallest ink print amount S can be selected within a range capable of printing both the dots a and b in a stable ejection amount region. When this print method is employed, an image free from blurring and having a high density can be obtained even on a normal paper sheet.

As a method of printing two dots having different ejection amounts using a single head, PWM control utilizing a first pulse width of double pulses applied upon ejection driving of the head described in U.S. Ser. No. 821,773 (Jan. 16, 1992) (which was refiled as U.S. Ser. No. 08/104,261 (May 17, 1993)) filed by the present applicant is suitable. In FIG.

17, P1 indicates a pre-heat pulse ($T_1$) for performing PWM control, and P3 indicates a main heat pulse ($T_3-T_1$) applied after an interval ($T_2-T_1$) P2. An ink is ejected from the multi head in response to the pulse P3. At this time, the temperature of the head heated by the pulse P1 largely influences the ejection amount. Normally, when this PWM control is performed, the ejection amount is stabilized according to a change in temperature of the head. $V_{OP}$ indicates a driving voltage.

Figure 19:
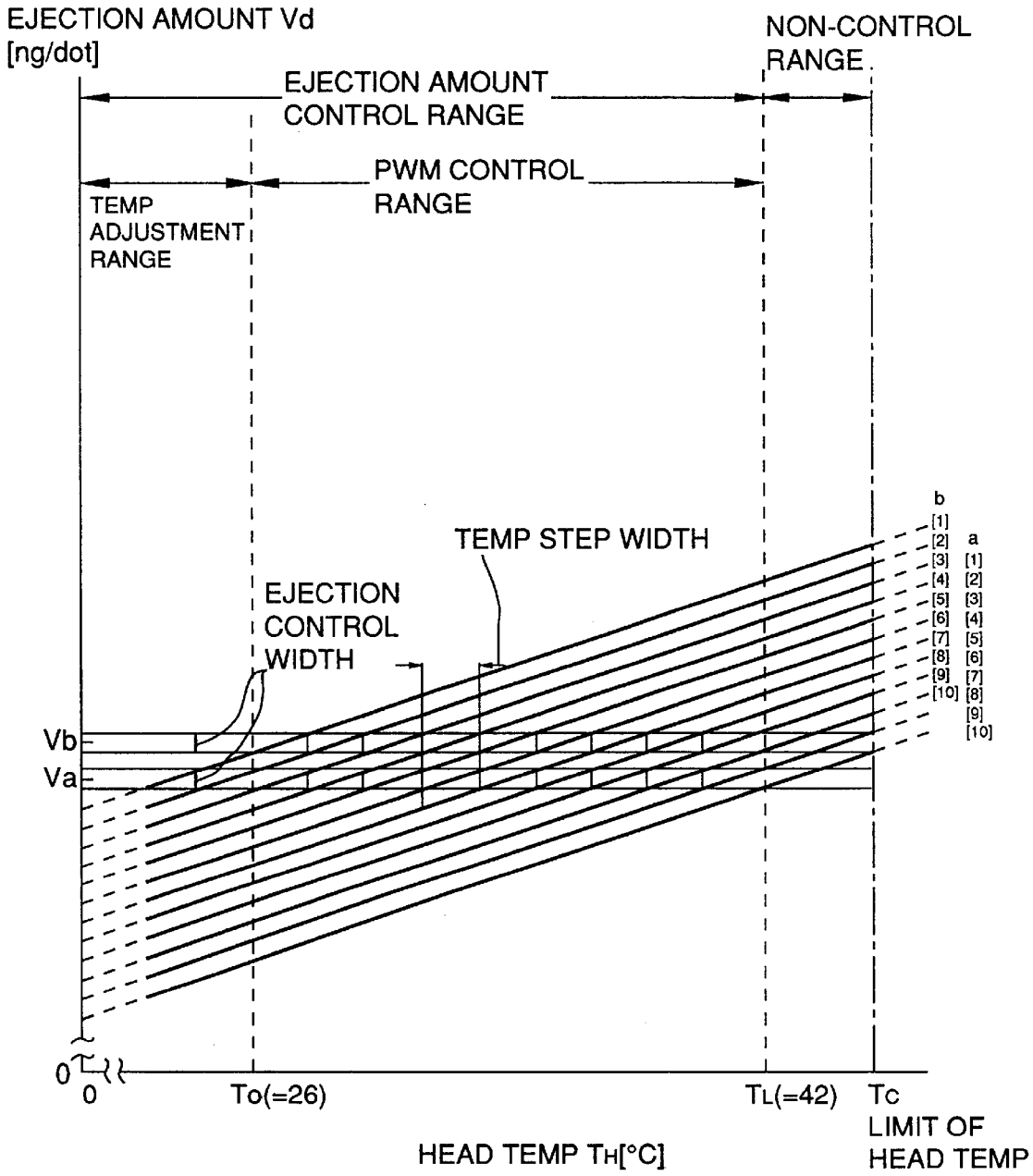
FIG. 19 is a graph showing an ejection amount control state based on PWM table conversion.

More specifically, the pulse width of the pre-heat pulse P1 is modulated according to a change in head temperature so as to stabilize the ejection amount based on the main heat pulse P3. FIGS. 18A and 18B show two different pulse width tables corresponding to the head temperature. As shown in FIG. 19, this PWM control is performed within a range wherein the ejection amount has almost a linear relationship with the head temperature. In the table shown in FIG. 18A, an ejection amount Va is always set, and in the table shown in FIG. 18B, an ejection amount Vb is always set. In this manner, the temperature is detected, and the ejection amount can be stabilized according to table setting.

When the table contents are changed between FIGS. 18A and 18B, the ejection amount target value can be switched between two values, i.e., Va and Vb. In the embodiment shown in FIG. 4D, the paper feed operation in units of a ½ pixel is performed, and PWM table conversion (FIGS. 18A and 18B) is performed for each scan to change the ejection amount, thereby realizing the print state shown in FIG. 15.

In this embodiment, the print operation is completed using different nozzles in two scan operations of the multi heads per print region having a multi-nozzle width like in the first embodiment. For this reason, the density can be efficiently increased, and density nonuniformity on the sheet surface caused by variations in various factors in the manufacture of multi heads can be eliminated. This print method will be described in detail below with reference to FIGS. 9A and 9B described previously.

In FIG. 9A, ○1 indicates a regular dot landing point, and corresponds to the dot a in FIG. 15. Contrary to this, Δ2 indicates a landing central point of a dot which is printed at a position shifted by half a pixel for the purpose of emphasis, and corresponds to the dot b in FIG. 15. The dots ○1 and Δ2 form one pixel to be printed. In this case, R and r (<R) are set to be respectively smaller and larger than R and r in a portion where S is the smallest in FIG. 16. Assume that the print blurring rate is set to be k=2.0, R=71.1 μm, and r=61.6 μm. In this case, the ejection amounts Va and Vb in FIG. 19 respectively become Va=15.3 pl/dot and Vb=23.5 pl/dot. Numbers (1, 2) written at the landing points in FIGS. 9A and 9B indicate the print order of two, i.e., large and small dots in each pixel.

The print sequence will be described below along the time base (abscissa) in FIG. 9B. After the paper feed operation is performed, in the first scan operation, dots ○1 are printed using the lower half portion of each multi head according to the setting content of the ejection amount Vb, i.e., the setting content of the table shown in FIG. 19B, and upper half nozzles do not perform the print operation. Upon completion of this print scan operation, a paper sheet is fed by (n/2+½) pixels in the y-direction upon rotation of the paper feed roller 703 shown in FIG. 1. In this stage, paying attention to, e.g., a region having a width corresponding to (n/2+½) pixels indicated by d1 of a print start portion on the sheet surface, dots of four colors are printed on only a portion of ○1 in this region.

Then, a new scan operation is performed. In this case, the positional relationship between the multi nozzles and the sheet surface is shifted by half a pixel in a (−y)-direction from a regular state by the above-mentioned paper feed operation. During this interval, the head PWM table is converted from FIG. 18B to FIG. 18A, and the ejection amount is set to be Va. In this state, the upper and lower nozzles of all the heads print dots Δ2. At this time, the print timing is shifted by a ½ pixel in the main scanning direction. When this scan operation is completed, dots printed in the region d1 include the dots ○1 of four colors printed by the lower half portion of each head in the previous scan operation, and the dots Δ2 of four colors printed by the upper half portion of each head in the current scan operation. After the paper sheet is fed, the third scan operation is performed. The paper feed amount by the paper feed roller 703 at this time corresponds to (n/2−½) pixels unlike in the previous paper feed operation. In this manner, the multi nozzles and the print surface can have the regular positional relationship therebetween again.

The PWM table of the multi heads is converted from FIG. 18A to FIG. 18B in turn, and the ejection amount Vb is set again. In this state, all the heads of four colors print ○1.

Upon completion of the third print operation, the print operations of ○1 and Δ2 landing portions are completed in the order of ○1→Δ2 in the region d1 having a width of (n+½) pixels, and are completed in the order of Δ2→○1 in a region d2 having a width of (n+½) pixels. In reconsideration of the regions d1 and d2 printed in this manner, since both ○1 and Δ2 are printed by the different, i.e., upper and lower portions of each multi head, the print habits of the individual multi nozzles are reduced, and density nonuniformity on the print surface in the nozzle aligning direction as a problem to be solved can be eliminated. When the dots ○1 and Δ2 are printed, they satisfactorily overlap each other to have a minimum overlapping area. In other words, since the density is efficiently increased, absorption of the ink to a paper sheet can be promoted, and blurring between different colors can be eliminated.

Furthermore, in this embodiment, four colors, i.e., cyan, magenta, and yellow, and black are similarly subjected to overlapping print operations. The print order of these colors may be changed, or the four colors may use different PWM tables depending on the way of blurring among different colors. For example, when only black of the four colors is to be emphasized, only the dots ○1 may be printed for the four colors, and the dots Δ2 may be printed for only the color to be emphasized. In this manner, the color to be emphasized can be further emphasized as compared to the remaining colors.

(Fifth Embodiment)

As the fifth embodiment, a "four-pass fine print method" will be described below with reference to FIGS. 4A to 4D, FIGS. 10A and 10B, and FIGS. 11A and 11B described previously. As described in the above embodiment, in this embodiment, the dot landing state shown in FIG. 4D is also attained like in the fourth embodiment.

In the fourth embodiment, each head is divided into two portions, and the print operation is attained by two scan operations per ½ head region. However, in this embodiment, the print operation is completed by four scan operations of each multi head per ¼ width print region of each multi head like in the second embodiment. This is to further effectively eliminate the density nonuniformity on the sheet surface caused by the ink density (especially the black density) and variations in various factors in the manufacture of the multi head, and blurring at a boundary between adjacent different colors as the most serious problem on a normal paper sheet.

FIGS. 11A and 11B show the print method of this embodiment in detail like in FIGS. 9A and 9B of the first embodiment. In FIG. 11A, ○1 and ○3 indicate regular dot landing points, which are landing central points having a dot diameter R like in the first embodiment. On the contrary, Δ2 and Δ4 indicate landing points having a dot diameter r, and shifted by half a pixel from the dots ○1 and ○3.

The print sequence will be described below along the time base (abscissa) in FIG. 11B. After a paper sheet is fed, in the first scan operation, 3n/4 nozzles of the four divided portions counted from the distal end portion of each multi head, i.e., from a portion closest to the end portion of the paper sheet do not perform a print operation. Only the remaining n/4 nozzles print ○1 in the ejection amount Vb. Upon completion of this print scan operation, the paper sheet is fed by (n/4+½) pixels in the y-direction. As the paper feed driving method, the method shown in FIG. 5 or 6 described in the first embodiment is used. In this stage, paying attention to, e.g., a region having a width corresponding to (n/4+½) pixels indicated by d1 of a start portion of the print region on the sheet surface, dots of four colors are printed on only a portion of ○1 in this region.

Then, a new scan operation is performed. In this case, the positional relationship between the multi nozzles and the sheet surface is shifted by half a pixel in a (−y)-direction from a regular state by the above-mentioned paper feed operation. The PWM table is then converted from FIG. 18B to FIG. 18A to set the ejection amount Va. In this state, of the remaining portions, the upper portion prints dots Δ2 using four color inks, and the lower portion print dots Δ4 using the four color inks. Upon completion of this scan operation, dots printed in the region d1 are four-color dots ○1 printed in the previous scan operation, and four-color dots Δ2 printed in the current scan operation. In a region d2 below the region d1 having the same width, only the dots Δ4 are printed.

The third scan operation is performed after the paper sheet is fed. At this time, the paper feed amount is set to be (n/4−½) pixels unlike in the previous paper feed operation. In this manner, the multi nozzles and the print surface can have the regular positional relationship again. The ejection amount Vb is set again. Using all the heads of four colors, n/4 nozzles corresponding to the uppermost portion do not perform a print operation, and the remaining three portions perform a print operation in the order of ○3, ○1, and ○3. In this stage, dots printed on the region d1 are dots ○1, Δ2, and ○3, dots printed on the region d2 are dots Δ4 and ○1, and dots printed on a region d3 below the region d2 are dots ○3.

Then, the paper sheet is fed by (n/4+½) pixels again, so that the head and the sheet surface have the positional relationship shifted by half a pixel again. The ejection amount Va is set again, and the print operation is performed in the order of Δ4, Δ2, Δ4, and Δ2 in units of n/4 nozzles using all the heads of four colors. Upon completion of this scan operation, the print operations of all the landing portions ○1, Δ2, ○3, and Δ4 are completed on the region d1, dots Δ4, ○1, and Δ2 are printed on the region d2, dots ○3 and Δ4 are printed on the region d3, and dots Δ2 are printed on a region d4 below the region d3.

By another paper feed operation by (n/4−½) pixels, the multi heads are moved to a position separated from this region, and the region d2 is completed this time. When such print operations are repeated, dots shown in FIG. 11A land in the order from the left side of each region shown in FIG. 11B, that is, in the order of ○→Δ2→○3→Δ4 on the region d1, in the order of Δ4→○1→Δ2→○3 on the region d2, in the order of ○3→Δ4→○1→Δ2 on the region d3, and in the order of Δ2→○3→Δ4→○1 on the region d4.

According to this embodiment, dots are printed to satisfactorily overlap each other while minimizing their overlapping areas. Thus, in addition to the effect of the second embodiment, absorption of the ink to a paper sheet can be promoted, and blurring between different colors can be eliminated.

(Sixth Embodiment)

As the sixth embodiment, an "eight-pass fine print method" will be described below with reference to FIGS. 12A to 12C described previously. This method is a further extended method of the "four-pass fine print method" of the fifth embodiment in consideration of further limitation of blurring as compared to the fifth embodiment.

In FIG. 12A, ○1, ○3, ○5, and ○7 indicate regular dot landing points, which are landing central points having a dot diameter R. Contrary to this, Δ2, Δ4, Δ6, and Δ8 indicate landing points having a dot diameter r, which are shifted by a ½ pixel. Like in the fifth embodiment, in the print regions shown in FIGS. 12A and 12B, ○1 to Δ8 represent that landing points having the same number are printed in a single scan operation.

FIG. 12C shows a print sequence of the head level like in the fifth embodiment. In this embodiment, a paper sheet is fed in the y-direction by a width corresponding to the number of nozzles obtained by equally dividing the number n of nozzles of the multi head with 8, i.e., by (n/8+½) pixels or by (n/8−½) pixels alternately. When the dots ○1, ○3, ○5, and ○7 are printed, the ejection amount Vb is set; when Δ2, Δ4, Δ6, and Δ8 are printed, the ejection amount Va is set. In this print method, in regions d1 to d8 each having a width corresponding to (n/8+½) pixels, pixels are formed by eight scan operations of the multi heads using eight different nozzle portions.

Since the dots are formed at distributed positions in a unit region using eight different nozzle portions, the print habits of the nozzles can be further reduced as compared to the four-pass print method of the fifth embodiment, and a high-quality image free from blurring can be obtained. Since each multi head is scanned eight times in this embodiment, this embodiment is particularly effective for an ink jet recording apparatus having a multi head whose number n of nozzles is large, as compared to the fifth embodiment. In addition, since the dots are printed to satisfactorily overlap each other to minimize their overlapping areas, absorption of the ink to a paper sheet can be promoted, and blurring between different colors can be eliminated.

The control arrangement for executing recording control of the fourth to sixth embodiments is the same as that shown in FIGS. 13 and 14 described above, and a detailed description thereof will be omitted.

As described above, since a paper sheet is fed by an amount less than one pixel, and since dots land in different ejection amounts at a plurality of print landing points per pixel, blurring can be further efficiently eliminated as compared to the conventional method, the density nonuniformity caused by individual multi nozzles can be prevented, and the density can be increased, thus obtaining a high-quality image.

(Seventh Embodiment)

Figure 20A:
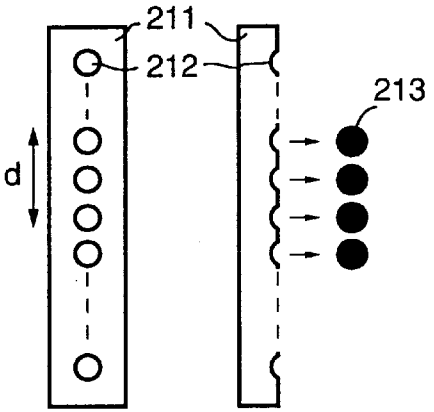
FIGS. 20A to 20C are views for explaining a print method according to the seventh embodiment of the present invention.
Figure 20B:
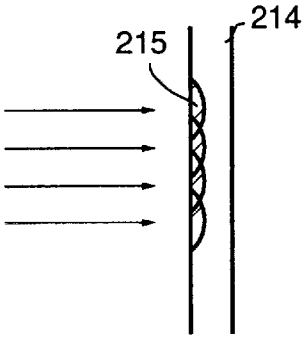
Figure 20C:
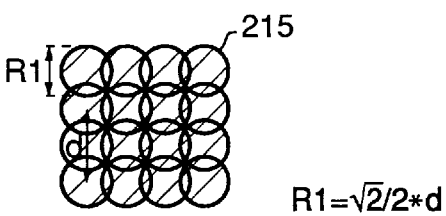

The seventh embodiment of the present invention will be described below. FIGS. 20A to 20C are views showing the print state when an area factor of 100% is satisfied by printing four dots per pixel in this embodiment, and FIGS. 21A to 21C are views showing, in comparison with FIGS. 20A to 20C, the print state when an area factor of 100% is satisfied by printing one dot per pixel according to the conventional method.

Figure 21A:
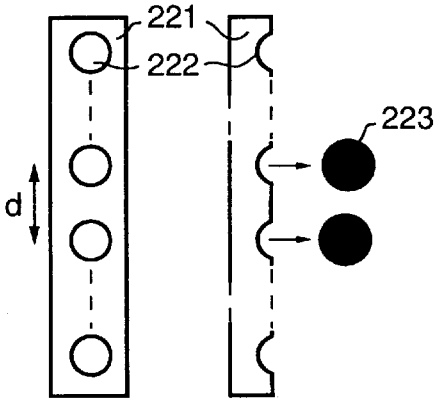
FIGS. 21A to 21C are views for explaining a conventional print method in comparison with the seventh embodiment.
Figure 21B:
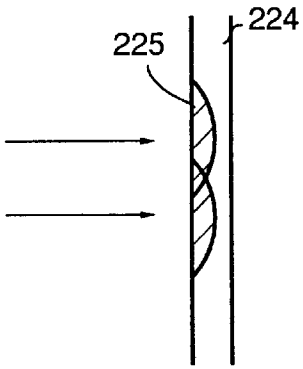
Figure 21C:
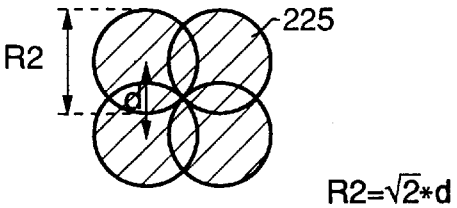

FIGS. 20A and 21A are views showing heads used in the corresponding cases when viewed from the ejection direction. In FIG. 20A or 21A, a multi head 211 or 221 has ejection orifices 212 or 222. The ejection orifices 212 number twice that of the ejection orifices 222 and are present at a pitch half that of the orifices 222, and each ejection orifice 212 is formed to be slightly smaller than the ejection orifice 222. FIGS. 20B and 21B show the heads 211 and 221, ink droplets (213 and 223) ejected from the corresponding heads, and landing states (215 and 225) in paper sheets (214 and 224) when the ink droplets land on the paper sheets. Furthermore, FIGS. 20C and 21C show ink dot landing states of ink dots (215 and 225) landing on the sheet surfaces when viewed from a direction perpendicular to the sheet surface.

In these drawings, d represents a distance per pixel unit, and corresponds to about 70.5 $\mu$m at a pixel density of, e.g., 360 dpi. In FIGS. 21A to 21C, each d×d pixel region has one landing point, and a dot diameter R2 of the landing dot is set, so that adjacent dots in the diagonal direction contact each other, i.e., $R2=\sqrt{2}*d$. In contrast to this, in this embodiment, as shown in FIG. 20C, one d×d pixel region has four landing points, and one pixel is formed by four dots. In this case, R1 is set so that adjacent dots in the diagonal direction contact each other to satisfy the upper limit area factor, and is given by $R1=\sqrt{2}/2*d$.

Assuming that each ink droplet (213 or 223) has a true spherical shape, if the ratio of the dot diameter on the sheet surface to the diameter of this ink droplet is defined as a blurring rate $\alpha$, the diameters of ink droplets 213 and 223 are respectively represented by:

$$r1=R1/\alpha$$

$$r2=R2/\alpha$$

Therefore, the volumes of these droplets, i.e., the ejection amounts are represented by:

$$\begin{aligned} v1 &= 4\pi r1^3/3 \\ &= 4\pi(R1/2\alpha)^3/3 \\ &= 4\pi\left(\sqrt{2}\,d/4\alpha\right)^3/3 \\ v2 &= 4\pi r2^3/3 \\ &= 4\pi(R2/2\alpha)^3/3 \\ &= 4\pi\left(\sqrt{2}\,d/2\alpha\right)^3/3 \end{aligned}$$

Furthermore, since one dot is printed for one pixel in FIGS. 21A to 21C, an ink print amount V2 per pixel (d×d), i.e., per unit area is represented by:

$$V2=v2/(d\times d) \quad (1)$$

On the other hand, in FIGS. 20A to 20C of this embodiment, since one pixel is formed by four dots, an ink print amount V1 per unit area is represented by:

$$V1=4\times v1/(d\times d) \quad (2)$$

Therefore, we have:

$$\begin{aligned} V1/V2 &= 4\times v1/v2 \\ &= 4\times 4\pi\left(\sqrt{2}\,d/4\alpha\right)^3/3 \Big/ 4\pi\left(\sqrt{2}\,d/2\alpha\right)^3/3 \\ &= 1/2 \end{aligned}$$

When the print method of this embodiment (FIGS. 20A to 20C) is used, an area factor of 100% can be attained in an ink print amount half that of the conventional method (FIGS. 21A to 21C). For example, as actual values of this embodiment, when a print operation is performed using an ink and a paper sheet having a blurring rate $\alpha$=2.0 by a 360-dpi ink jet printer, since d≅70.5 $\mu$m, this value can be substituted in equations (1) and (2), and we obtain:

$$V1\cong 6.53\ \text{nl/mm}^2$$

$$V2\cong 13.07\ \text{nl/mm}^2$$

Thus, an ink amount of about 6.5 nl/mm$^2$ can be decreased per unit area.

Since the absorption speed of the ink to a paper sheet depends on the ink surface density, i.e., the ink print amount per unit area, even at the same area factor, this embodiment can eliminate blurring at a boundary between adjacent different colors as compared to the conventional method, and a high-quality image can be obtained.

As described above, this embodiment has ink landing points at precision twice that in the conventional method. In the head aligning direction, the ejection orifices of the nozzles are decreased in size, and nozzles twice as large in number as those of the conventional head are arranged at a ½ pitch. In the other direction, i.e., in the carriage moving direction, the carriage speed may be set to be ½, and the print operation may be performed at the same frequency as that in the conventional method. Alternatively, the ejection frequency (refill frequency) may be doubled, and the print operation may be performed while the carriage speed is left unchanged. In either method, a proper method or value may be selected from the viewpoint of time cost, a refill frequency, and an image to be printed.

(Eighth Embodiment)

As the eighth embodiment, a one-pass print method using a head shown in FIG. 22A will be described below. In this embodiment, a print dot landing state is attained in the ejection amount and the dot diameter shown in FIGS. 15 and 16 like in the fourth to sixth embodiments. However, the difference between this embodiment and the above-mentioned embodiments is that ink droplets in two different ejection amounts are ejected using a head having two different types of nozzles, as shown in FIG. 22A, to complete the landing state.

Figure 22C:
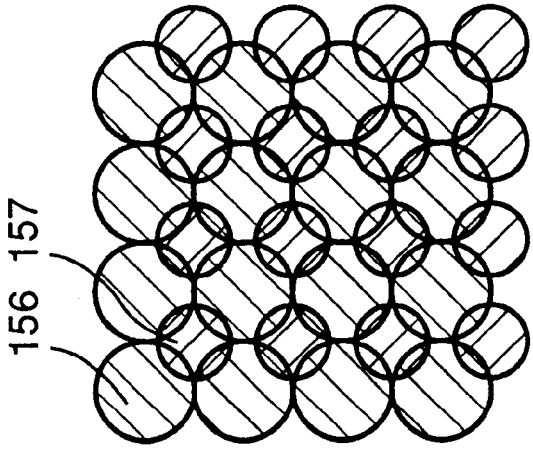
FIGS. 22A to 22C are views for explaining a print method according to the eighth embodiment of the present invention.
Figure 22B:
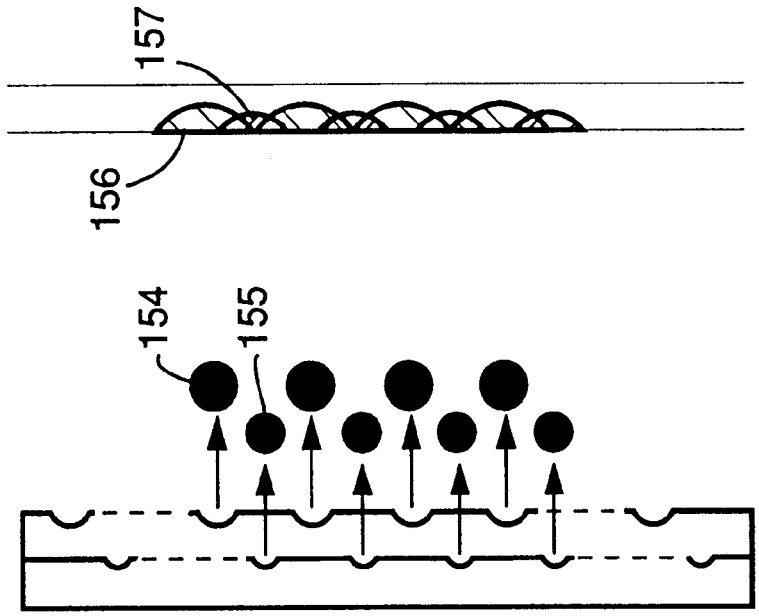
Figure 22A:
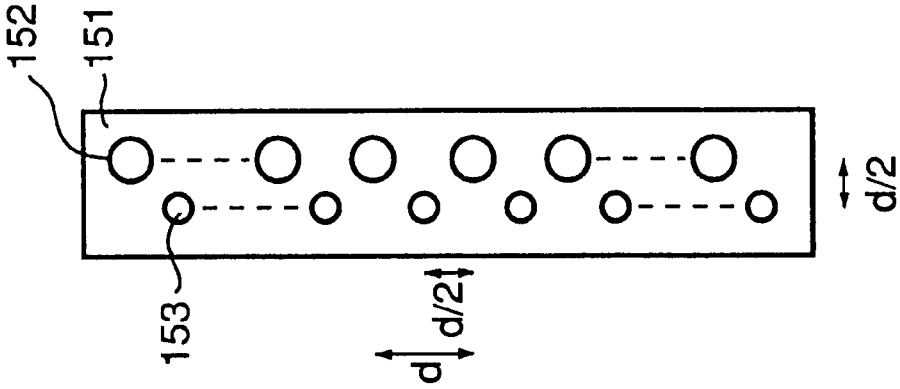
Figure 1:
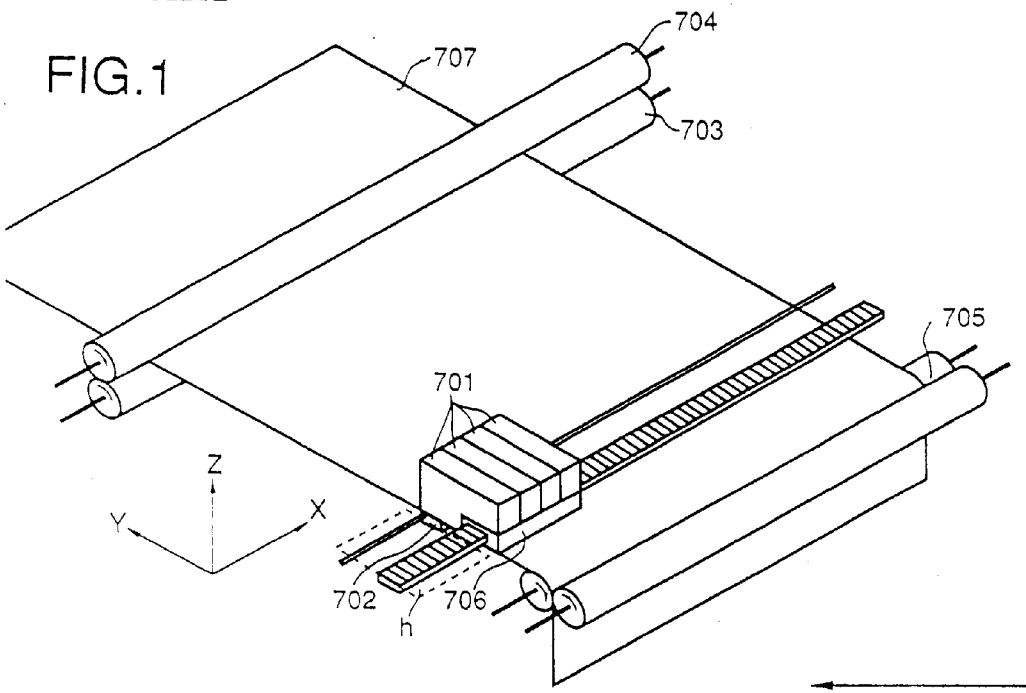
PRIOR ART FIG.1
Figure 2:
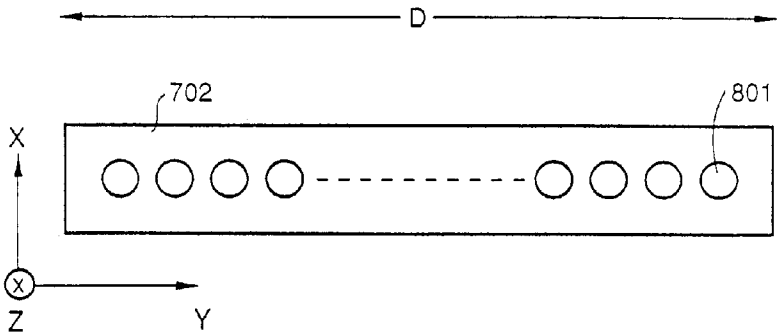
PRIOR ART FIG.2
Figure 3A:
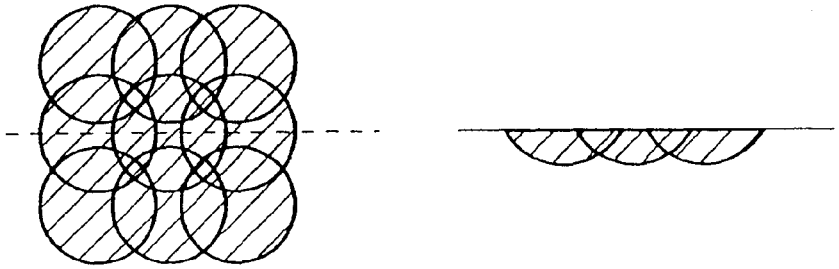
PRIOR ART FIG.3A
Figure 3B:
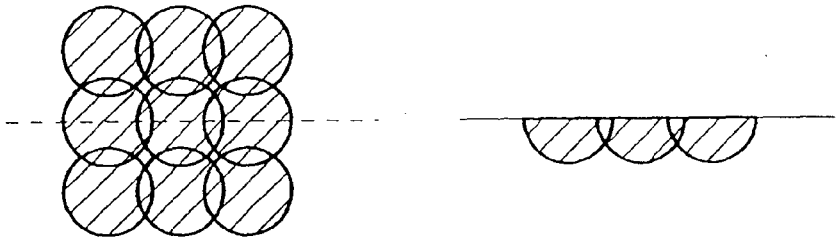
PRIOR ART FIG.3B
Figure 3C:
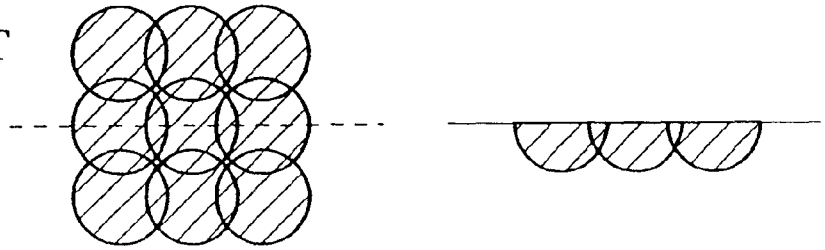
PRIOR ART FIG.3C
Figure 4A:
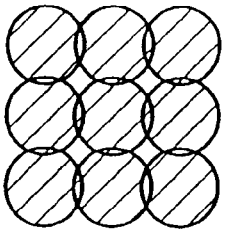
PRIOR ART FIG.4A
Figure 4B:
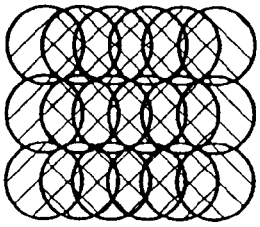
PRIOR ART FIG.4B
Figure 4C:
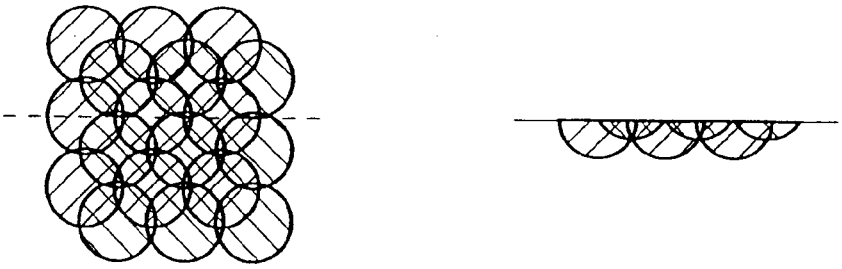
Figure 4D:
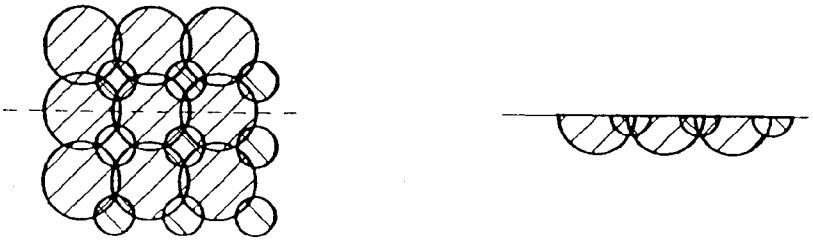
Figure 20A:
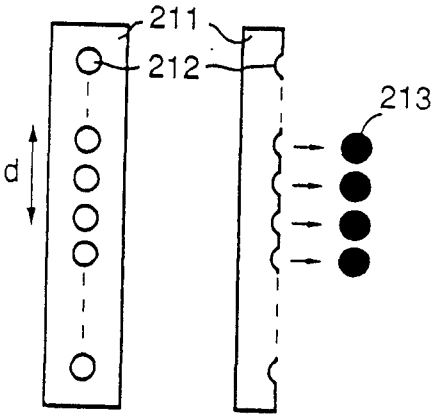
Figure 20B:
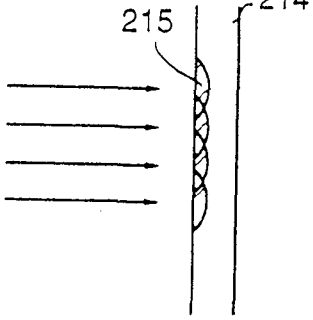
Figure 20C:
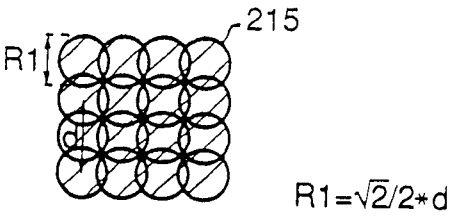
Figure 21A:
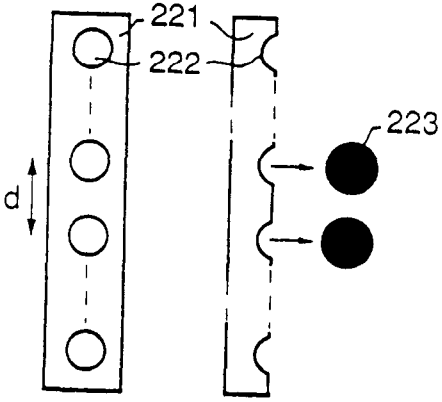
PRIOR ART FIG.21A
Figure 21B:
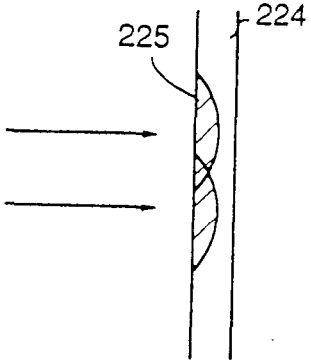
PRIOR ART FIG.21B
Figure 21C:
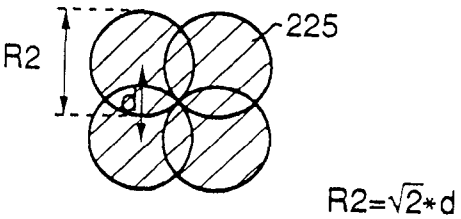
PRIOR ART FIG.21C

FIGS. 22A to 22C correspond to FIGS. 20A to 20C and FIGS. 21A to 21C described in the seventh embodiment. A multi head 151 used in this embodiment has ejection orifices 152 for the ejection amount Vb, and ejection orifices 153 for the ejection amount Va. In FIG. 22B, ink droplets 154 are ejected from the ejection orifices 152, and ink droplets 155 are ejected from the ejection orifices 153. The ink droplets 154 and 155 land on the sheet surface in landing states 156 and 157, respectively. The ejection orifices 152 and 153 on the multi head are aligned to be already shifted by a half pixel pitch (d/2). When two different types of dots are simultaneously ejected, ink droplets can land at positions shifted by half a pixel, as shown in FIG. 22C.

This print operation requires neither paper feed control in units of ½ pixels nor PWM control for controlling the ejection amounts Va and Vb, and the print time can be shortened since the print operation is attained by one pass. Furthermore, the density nonuniformity can be eliminated to an extent equivalent to the above embodiments.

The present invention brings about excellent effects particularly in a recording head and a recording device of the ink jet system using a thermal energy among the ink jet recording systems.

As to its representative construction and principle, for example, those practiced by use of the basic principle disclosed in, for instance, U.S. Pat. Nos. 4,723,129 and 4,740,796 is preferred. The above system is applicable to either one of the so-called on-demand type and the continuous type. Particularly, the case of the on-demand type is effective because, by applying at least one driving signal which gives rapid temperature elevation exceeding nucleate boiling corresponding to the recording information on electrothermal converting elements arranged in a range corresponding to the sheet or liquid channels holding liquid (ink), a heat energy is generated by the electrothermal converting elements to effect film boiling on the heat acting surface of the recording head, and consequently the bubbles within the liquid (ink) can be formed in correspondence to the driving signals one by one. By discharging the liquid (ink) through a discharge port by growth and shrinkage of the bubble, at least one droplet is formed. By making the driving signals into pulse shapes, growth and shrinkage of the bubble can be effected instantly and adequately to accomplish more preferably discharging of the liquid (ink) particularly excellent in accordance with characteristics. As the driving signals of such pulse shapes, the signals as disclosed in U.S. Pat. Nos. 4,463,359 and 4,345,262 are suitable. Further excellent recording can be performed by using the conditions described in U.S. Pat. No. 4,313,124 of the invention concerning the temperature elevation rate of the above-mentioned heat acting surface.

As a construction of the recording head, in addition to the combined construction of a discharging orifice, a liquid channel, and an electrothermal converting element (linear liquid channel or right angle liquid channel) as disclosed in the above specifications, the construction by use of U.S. Pat. Nos. 4,558,333 and 4,459,600 disclosing the construction having the heat acting portion arranged in the flexed region is also included in the invention. The present invention can be also effectively constructed as disclosed in Japanese Laid-Open Patent Application No. 59-123670 which discloses the construction using a slit common to a plurality of electrothermal converting elements as a discharging portion of the electrothermal converting element or Japanese Laid-Open Patent Application No. 59-138461 which discloses the construction having the opening for absorbing a pressure wave of a heat energy corresponding to the discharging portion.

In addition, the invention is effective for a recording head of the freely exchangeable chip type which enables electrical connection to the main device or supply of ink from the main device by being mounted onto the main device, or for the case by use of a recording head of the cartridge type provided integratedly on the recording head itself.

It is also preferable to add a restoration means for the recording head, preliminary auxiliary means, and the like provided as a construction of the recording device of the invention because the effect of the invention can be further stabilized. Specific examples of them may include, for the recording head, capping means, cleaning means, pressurization or aspiration means, and electrothermal converting elements or another heating element or preliminary heating means or a combination of the above. It is also effective for performing a stable recording to realize the preliminary mode which executes the discharging separately from the recording.

As a recording mode of the recording device, further, the invention is extremely effective for not only the recording mode of only a primary color such as black or the like but also a device having at least one of a plurality of different colors or a full color by color mixing, depending on whether the recording head may be either integratedly constructed or combined in plural number.

What is claimed is:

1. A recording method for ejecting black ink and colored inks onto a recording medium from a plurality of orifices of a recording head to form a color image, said method comprising the steps of:

storing image data;

main-scanning the recording head relative to the recording medium to record a thinned image at basic pixel positions;

sub-scanning by a length of an integer multiple number of pixel units plus a distance less than one pixel unit, with respect to one pixel formed on the recording medium;

main-scanning the recording head relative to the recording medium to record a thinned image of black ink ejections within a distance greater than zero and less than one pixel unit from the basic pixel positions;

sub-scanning by an integer multiple number of pixel units minus a distance less than one pixel unit, with respect to one pixel formed on the recording medium;

main-scanning the recording head relative to the recording medium to record a thinned image of black ink complementary to the thinned image recorded at the basic pixel positions;

sub-scanning by a length of an integer multiple number of pixel units plus a distance less than one pixel unit;

main scanning the recording head relative to the recording medium to record a thinned image of the black ink ejections complementary to the thinned image of the black ink recorded within a distance greater than zero and less than one pixel unit from the basic pixel positions;

sub-scanning by an integer multiple number of pixel units minus a distance less than one pixel unit, with respect to one pixel formed on the recording medium; and recording the color image by executing a control operation such that recording by the black ink is performed by ejecting the black ink within a distance greater than zero and less than one pixel unit from the basic pixel positions to effect shifted recording and recording by the colored inks other than the black ink is performed by ejecting the colored inks from said recording head without performing the shifted recording, two ink ejections of the black ink of a pixel in the image are performed using different orifices of the recording head, and one of at least two ink ejections of the black ink corresponding to one pixel based on the same image data stored in said storing step and another ink ejection of the black ink are performed during different scans of the recording head, wherein the black ink ejections of the image recorded within a distance greater than zero and less than one pixel unit from the basic pixel positions are recorded on the basis of the same image data stored in said storing step as that of the black ink ejections of the image recorded at the basic pixel positions.

2. A recording method according to claim 1, wherein the recording head has means for ejecting inks using thermal energy.

3. A method according to claim 1, wherein the image data comprises binary data.

* * * * *

UNITED STATES PATENT AND TRADEMARK OFFICE

CERTIFICATE OF CORRECTION

PATENT NO. : 6,540,326 B2
DATED : April 1, 2003
INVENTOR(S) : Miyuki Matsubara et al.

It is certified that error appears in the above-identified patent and that said Letters Patent is hereby corrected as shown below:

Title page,
Item [56], References Cited, U.S. PATENT DOCUMENTS, "Stenkweather et al." should read -- Sterkweather et al. --;
FOREIGN PATENT DOCUMENTS, "59123670 7/1984" should read -- 59-123670 7/1984 -- and "59138461 8/1984" should read -- 59-138416 8/1984 --; and
OTHER PUBLICATIONS, "249-250.*" should read -- 249-250. --.

Figure 2:
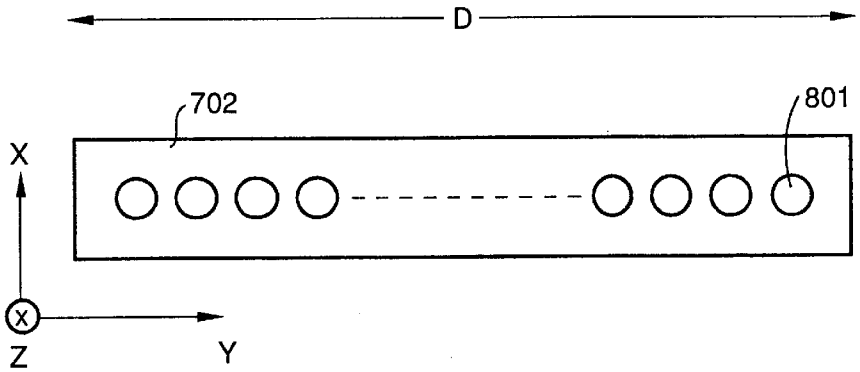
FIG. 2 is a view showing a state of multi nozzles on a multi head.
Figure 3A:
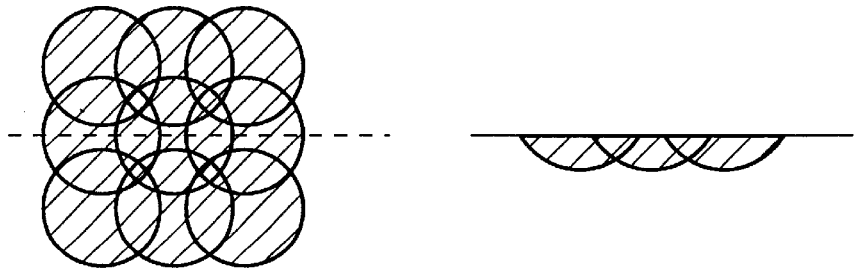
FIGS. 3A to 3C are views for comparing ink landing states of a coating paper sheet and a normal paper sheet.
Figure 3B:
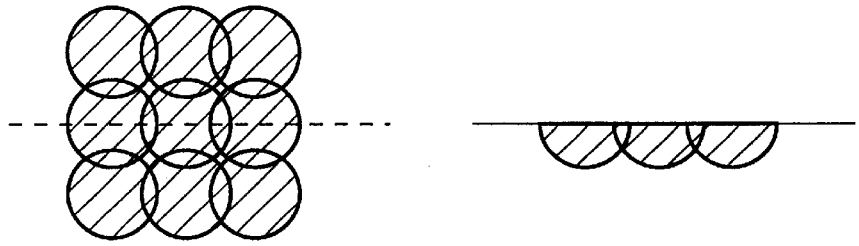
Figure 3C:
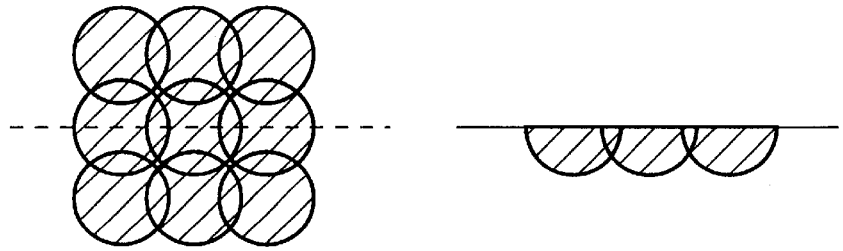

Drawings,
Sheet 1, Figures 1 and 2, substitute attached drawing sheet.
Sheet 2, Figures 3A-3C, substitute attached drawing sheet.
Sheet 3, Figures 4A-4D, substitute attached drawing sheet.
Sheet 19, Figures 20A-20C and 21A-21C, substitute attached drawing sheet.

Column 2,
Line 2, "or coating" should read -- or coated --.

Column 14,
Line 25, "$d \leq R \leq \sqrt{\sqrt{2d}}$" should read --$d \leq R \leq \sqrt{2d}$ --.

Signed and Sealed this

Thirtieth Day of December, 2003

JAMES E. ROGAN
*Director of the United States Patent and Trademark Office*